US008280092B2

(12) United States Patent
Inoda et al.

(10) Patent No.: US 8,280,092 B2
(45) **Date of Patent: *Oct. 2, 2012**

(54) VOICE SOUND INPUT APPARATUS

(75) Inventors: Takeshi Inoda, Osaka (JP); Rikuo Takano, Ibaraki (JP); Toshimi Fukuoka, Kanagawa (JP); Ryusuke Horibe, Osaka (JP); Fuminori Tanaka, Osaka (JP)

(73) Assignees: Funai Electric Advanced Applied Technology Research Institute Inc., Osaka (JP); Funai Electric Co., Ltd., Osaka (JP)

( * ) Notice: Subject to any disclaimer, the term of this patent is extended or adjusted under 35 U.S.C. 154(b) by 665 days.

This patent is subject to a terminal disclaimer.

(21) Appl. No.: 12/473,009

(22) Filed: May 27, 2009

(65) Prior Publication Data

US 2009/0310811 A1 Dec. 17, 2009

(30) Foreign Application Priority Data

May 27, 2008 (JP) ..... P2008-138486

(51) Int. Cl.

| | |
|---|---|
| ***H04R 11/04*** | (2006.01) |
| ***H04R 9/08*** | (2006.01) |
| ***H04R 21/02*** | (2006.01) |
| ***H04R 19/04*** | (2006.01) |

(52) U.S. Cl. ..... 381/357; 381/362; 381/365; 381/366

(58) Field of Classification Search ..... 381/91, 381/356, 357, 362, 365, 366, 375
See application file for complete search history.

(56) References Cited

U.S. PATENT DOCUMENTS

| | | | | |
|---|---|---|---|---|
| 5,848,170 | A * | 12/1998 | Mahieux et al. | 381/92 |
| 6,246,570 | B1 * | 6/2001 | Kim | 361/679.23 |
| 2008/0013758 | A1 * | 1/2008 | Tsai et al. | 381/122 |

FOREIGN PATENT DOCUMENTS

| | | |
|---|---|---|
| JP | 6233366 A | 8/1994 |
| JP | 2004-120717 | 4/2004 |
| JP | 2007-300513 | 11/2007 |

* cited by examiner

*Primary Examiner* — Matthew W Such
*Assistant Examiner* — Scott Stowe
(74) *Attorney, Agent, or Firm* — Osha Liang LLP

(57) ABSTRACT

A voice sound input apparatus, adapted to be inputted a sound and configured to output sound data, includes: a display unit; a first microphone, related to a first sound hole; a second microphone, related to a second sound hole; a signal processing unit; and a microphone holding unit, formed with the first sound hole, and adapted to extend toward a sound source predicted position; wherein a distance between the first sound hole and the second sound hole is a distance that a phase component of a sound strength ratio is lower than or equal to 0 dB, the sound strength ratio being a ratio between a strength of a sound component contained in differential sound pressure of sounds entered to the first sound hole and the second sound hole and a strength of sound pressure of the sound entered to the first sound hole.

21 Claims, 18 Drawing Sheets

VOICE SOUND INPUT APPARATUS

BACKGROUND

1. Field of the Invention

The present invention is related to a voice sound input apparatus.

2. Description of the Related Art

As voice input apparatuses capable of suppressing surrounding noise, for example, a close-talking type microphone apparatus utilizing a characteristic of a differential microphone has been proposed is disclosed in JP-A-2007-300513, and an arrangement in which an echo canceller is utilized as a noise canceller is disclosed in JP-A-2004-120717.

Also, in very recently, speech recognition systems and voice translation systems have been developed which are used, while users view display screens of mobile appliances such as portable telephones, PHS, PDA, and notebook type personal computers, or users view monitors of desktop type personal computers.

In such a case that a unidirectional microphone is arranged by utilizing a plurality of microphones, under such an environment that surrounding noise is generated from one specific direction and only target sounds are generated from another specific direction, the target sounds can be acquired in a superior SNR (signal-to-noise ratio). However, as also described in JP-A-2004-120717, if these plural sets of microphones are merely utilized as the unidirectional microphone in the above-described arrangement, then there is such a problem that when the surrounding noise is generated from another direction which is different from the above-explained specific direction, or noise is generated from the background located along the same direction as that of the target sounds, these noises cannot be canceled.

Also, in order to realize a high-precision noise eliminating function by utilizing a characteristic of a differential microphone, it is desirable to consider an adverse influence as to a delay distortion which is caused by a phase difference of sound waves which reach a plurality of microphones. As voice input apparatuses which are utilized in speech recognition systems and voice translation systems, for instance, consonants of English must be clearly extracted. In other to satisfy this requirement, it is desirable to construct the voice input apparatuses which can extract voices having frequencies up to, for example, frequency ranges of 7 KHz without any distortion.

SUMMARY

It is therefore one advantageous aspect of the invention to provide a voice input apparatus which is capable of suppressing surrounding noise and delay distortions, and also, capable of extracting voices of speakers with fidelity, and can be used, while a user views a display screen.

According to an aspect of the invention, there is provided a voice sound input apparatus, adapted to be inputted a sound and configured to output sound data, including: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole, and adapted to extend toward a sound source predicted position located at a vertical direction of a display screen of the display unit, wherein a distance between the first sound hole and the second sound hole is set so that a strength ratio between a strength of differential sound pressure of sounds entered to the first sound hole and the second sound hole and a strength of sound pressure of the sound entered to the first sound hole with respect to phase components becomes smaller than the strength ratio with respect to amplitude components in a case that the sounds have a predetermined frequency range.

The first sound hole is a sound pick-up opening corresponding to the first microphone, and the second sound hole is a sound pick-up opening corresponding to the second microphone.

The distance between the first sound hole and the second sound hole may be defined as a distance between a distinctive point that is located in an aperture plane of the first sound hole and a distinctive point that is located in an aperture plane of the second sound hole. For example, the distinctive point of the first sound hole may be a center point of the first sound hole, and the distinctive point of the second sound hole may be a center point of the second sound hole.

The sound source predicted position may be a mouth of a speaker.

According to this invention, a voice sound input apparatus that is capable of suppressing surrounding noise and delay distortions, and is capable of an extracting sound of a speaker with fidelity.

In the voice input apparatus, the predetermined frequency range may be a frequency range lower than or equal to 7 KHz.

According to another aspect of the invention, there is provided a voice sound input apparatus, adapted to be inputted a sound and configured to output sound data, including: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole, and adapted to extend toward a sound source predicted position located at a vertical direction of a display screen of the display unit; wherein the first microphone and the second microphone is located at a position where a distance between the first sound hole and the second sound hole is shorter than or equal to 8.1 mm.

In the voice input apparatus, the microphone holding unit may be detachably attached to a main body.

In the voice input apparatus, the signal processing unit may include a detecting unit configured to detect whether or not the microphone holding unit is attached to the main body, the signal processing unit may be configured to perform the signal processing based on the output from the first microphone in a case that the detecting unit detects that the microphone holding unit is not attached to the main body, and the signal processing unit may be configured to perform the signal processing based on the output from the first microphone and the output from the second microphone in a case that the detecting unit detects that the microphone holding unit is attached to the main body.

In the voice input apparatus, the microphone holding unit may be formed with the second sound hole.

According to still another aspect of the invention, there is provided a voice sound input apparatus, adapted to be inputted a sound and configured to output sound data, including: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole and the second sound hole, and adapted to extend toward a sound source predicted position located at a vertical direction of a display screen of the display unit; wherein: the signal processing unit includes a detecting unit configured to detect whether or not the microphone holding unit is attached to the main body; the signal processing unit is configured to perform the signal processing based on the output from the second microphone in a case that the detecting unit detects that the microphone holding unit is not attached to the main body; and the signal processing unit is configured to perform the signal processing based on the output from the first microphone and the output from the second microphone in a case that the detecting unit detects that the microphone holding unit is attached to the main body.

In the voice input apparatus, a sectional area of the first sound hole is equal to a sectional area of the second sound hole.

In the voice input apparatus, a volume of an internal space of the first sound hole is equal to a volume of an internal space of the second sound hole.

The internal space is defined by planes including the aperture plane and the walls.

The voice input apparatus may further includes: a first vibration plate corresponding to the first microphone; and a second vibration plate corresponding to the second microphone, wherein a path length from an opening plane of the first sound hole to the first vibration plate is equal to a path length from an opening plane of the second sound hole to the second vibration plate.

The path length from an opening plane of the sound hole to the vibration plate may be defined as a length from the center point of the sound hole to the vibration plate.

In the voice input apparatus, the signal processing unit may be configured to generate a differential signal between an output signal of the first microphone and an output signal of the second microphone.

The voice sound input apparatus may further includes a third vibration corresponding to both the first microphone and the second microphone, wherein a path length from an opening plane of the first sound hole to the third vibration plate is equal to a path length from an opening plane of the second sound hole to the third vibration plate.

In the voice input apparatus, a sectional area of the first sound hole may be larger than a sectional area of the second sound hole Specifically, the above configuration is effective in a case that voice sound input apparatus is mounted and used at a position where the second sound hole is lied closer to the sound source than the first sound hole.

The voice sound input apparatus may further includes a mounting unit, configured to place the first sound hole at a position where a distance between the first sound hole and a sound source predicted position is shorter than or equal to 90 mm.

In the voice input apparatus, the microphone holding unit may be configured to adjust a distance between the first sound hole and a sound source predicted position due to at least one of pivotal movement, telescopic movement and deforming movement.

In the voice input apparatus, the microphone holding unit may be configured to adjust the distance between the first sound hole and the second sound hole.

In the voice input apparatus, the microphone holding unit may be configured to maintain the distance between the first sound hole and the second sound hole.

For example, when the microphone holding unit includes the first sound hole and the second sound hole, and when the pivotal movement, the telescopic movement and the deforming movement is not performed between the first sound hole and the second sound hole, the distance between the first sound hole and the second sound hole is maintained.

In the voice input apparatus, the signal processing unit is configured to perform a beam forming processing in a predetermined angle range with reference to a predetermined direction.

In the voice input apparatus, the signal processing unit may include a switching process unit configured to switch whether or not the beam forming processing is performed.

In the voice input apparatus, the signal processing unit may include a microphone sensitivity detecting unit configure to detect a sensitivity of at least one of the first microphone and the second microphone, and the signal processing unit may be configured to switch whether or not the beam forming processing is performed based on a detection result of the microphone sensitivity detecting unit.

In the voice input apparatus, the predetermined direction may be a direction directed from the second sound hole to the first sound hole.

BRIEF DESCRIPTION OF THE DRAWINGS

Embodiment may be described in detail with reference to the accompanying drawings, in which.

DETAILED DESCRIPTION OF THE INVENTION

Referring now to drawings, a description is made of various embodiment modes to which the present invention has been applied. It should be noted that the present invention is not limited only to the below-mentioned embodiment modes. Also, it is so assumed that the present invention may cover any inventive ideas made by freely combining the below-mentioned contents with each other.

Figure 1:
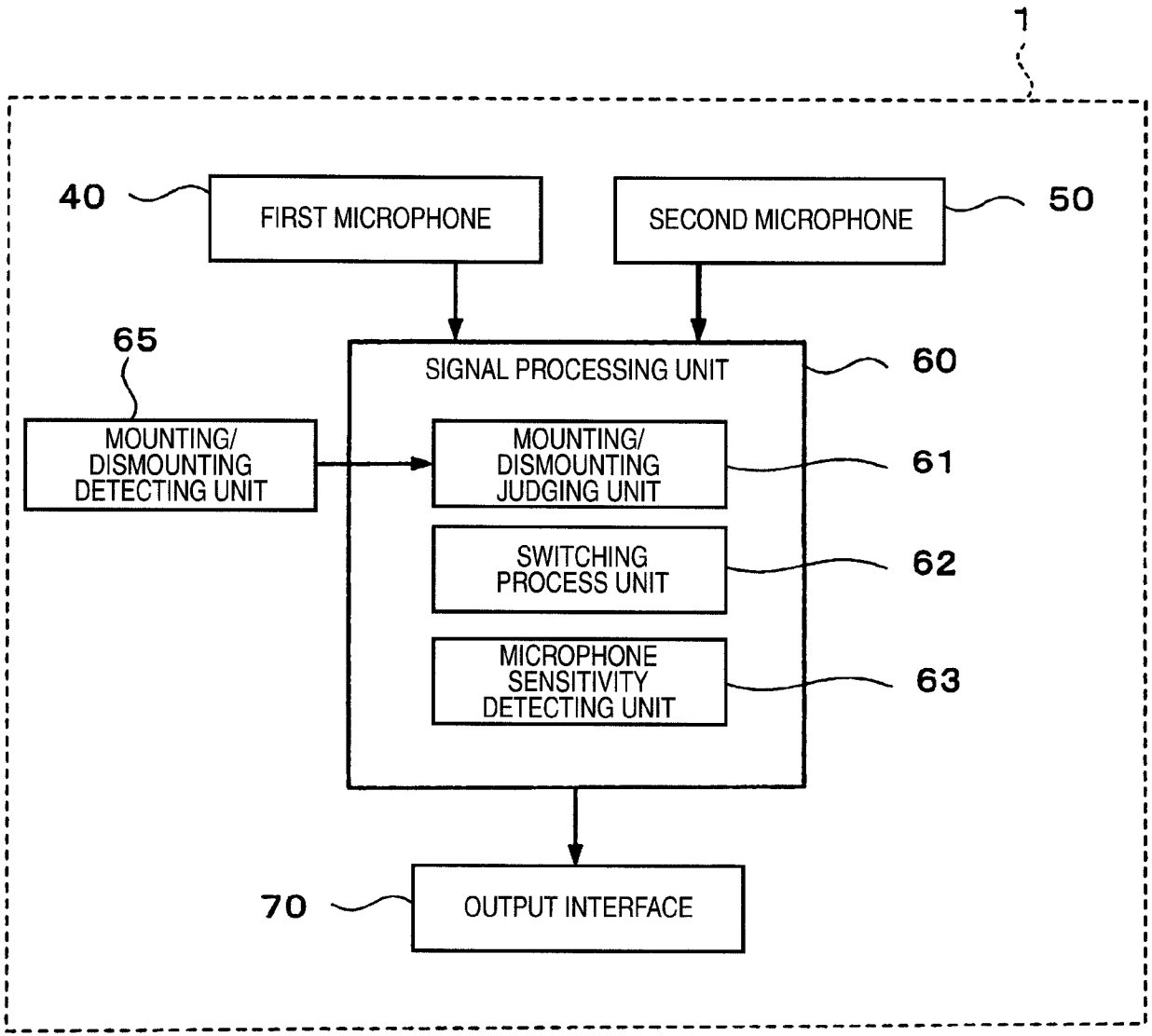
FIG. 1 is a functional block diagram for showing a structural example of a voice input apparatus according to an embodiment mode of the present invention.

FIG. 1 is a functional block diagram for showing one example as to an internal arrangement of a voice input apparatus 1 according to an embodiment mode of the present invention. For instance, mobile appliances such as a portable telephone, PHS, PDA, and a notebook type personal computer, and also, a desktop type personal computer are covered by the voice input apparatus.

The voice input apparatus 1, according to the present embodiment mode, contains a first microphone 40, a second microphone 50, and a signal processing unit 60. Both the first microphone 40 and the second microphone 50 convert voices entered thereinto into electric signals. The signal processing unit 60 produces voice signals based upon output signals from the first microphone 40 and the second microphone 50. A detailed description will be later made of the above-explained signal processing unit 60.

Also, the voice input apparatus 1 may alternatively contain an output interface 70 which is provided in order to output the voice signals produced by the signal processing unit 60 to other processing circuits and other electronic appliances. The output interface 70 may be connected to other processing circuits and other electronic appliances via electrodes, connectors, or cables. Alternatively, the output interface 70 may be communicated with other processing circuits and other electronic appliances by utilizing wireless communications.

Figure 2:
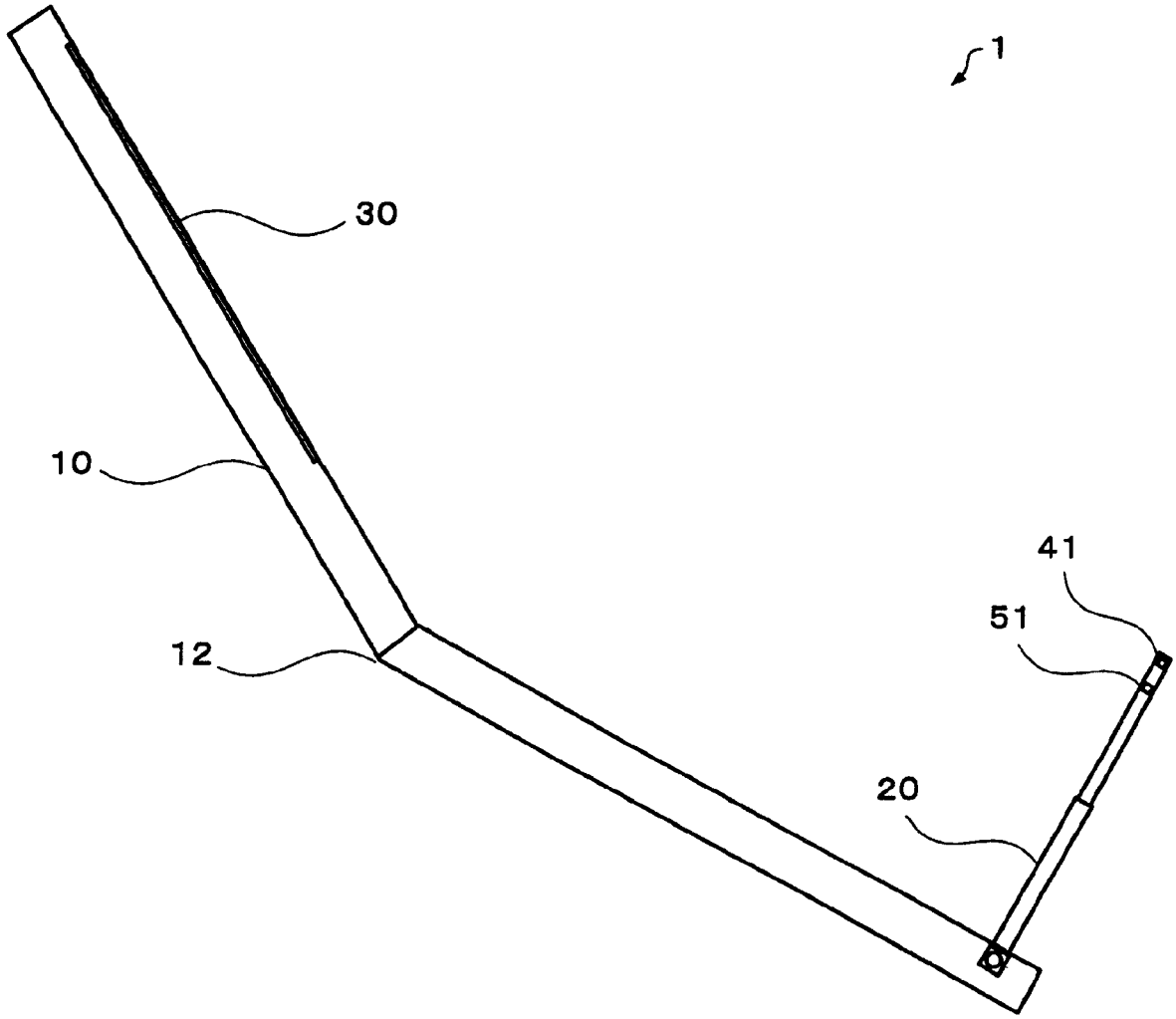
FIG. 2 is a diagram for indicating an example as to a construction of a voice input apparatus according to the present embodiment mode.

FIG. 2 is a side view for representing one example as to a structure of the above-described voice input apparatus 1 according to the present embodiment mode. The voice input apparatus 1 shown in FIG. 2 is an example of a portable telephone.

The voice input apparatus 1, according to the present embodiment mode, corresponds to an apparatus for inputting thereinto a voice so as to output a voice signal. The voice input apparatus 1 has been constructed by containing a main body 10, a microphone holding unit 20, and a display unit 30.

No specific limitation is made as to an outer appearance of the main body unit 10. In the present embodiment mode, the outer shape of the main body 10 has been formed in such a manner that two members having substantially rectangular parallelepiped are connected to each other by a folding unit 12.

The microphone holding unit 20 has such a rod shape which is directed to a sound source position predicted toward a vertical direction of a display screen of the display unit 30 (will be discussed later). No specific limitation is made as to an outer appearance of the microphone holding 20. In the present embodiment mode, the outer shape of the microphone holding unit 20 has been formed in such a rod shape whose sectional view is made circular.

Alternatively, the microphone holding unit 20 may be constructed in a pivotable manner, while a mounting unit 21 is defined as an axis. As a result, a user may adjust the direction of the microphone holding unit 20.

The display unit 30 is provided on a surface portion of the main body 10, and has a display screen on the surface of this display unit 30. No specific limitation is made as to a shape of the display screen. In the present embodiment mode, the display screen of the display unit 30 has been constructed in a rectangular shape.

The voice input apparatus 1, according to the present embodiment mode, contains the first microphone 40 and the second microphone 50. The first microphone 40 has been constructed by containing a first sound hole 41 and a first vibration plate 42 (not shown) corresponding to the first sound hole 41. Similarly, the second microphone 50 has been constructed by containing a second sound hole 51 and a second vibration plate 52 (not shown) corresponding to the second sound hole 51.

Figure 3:
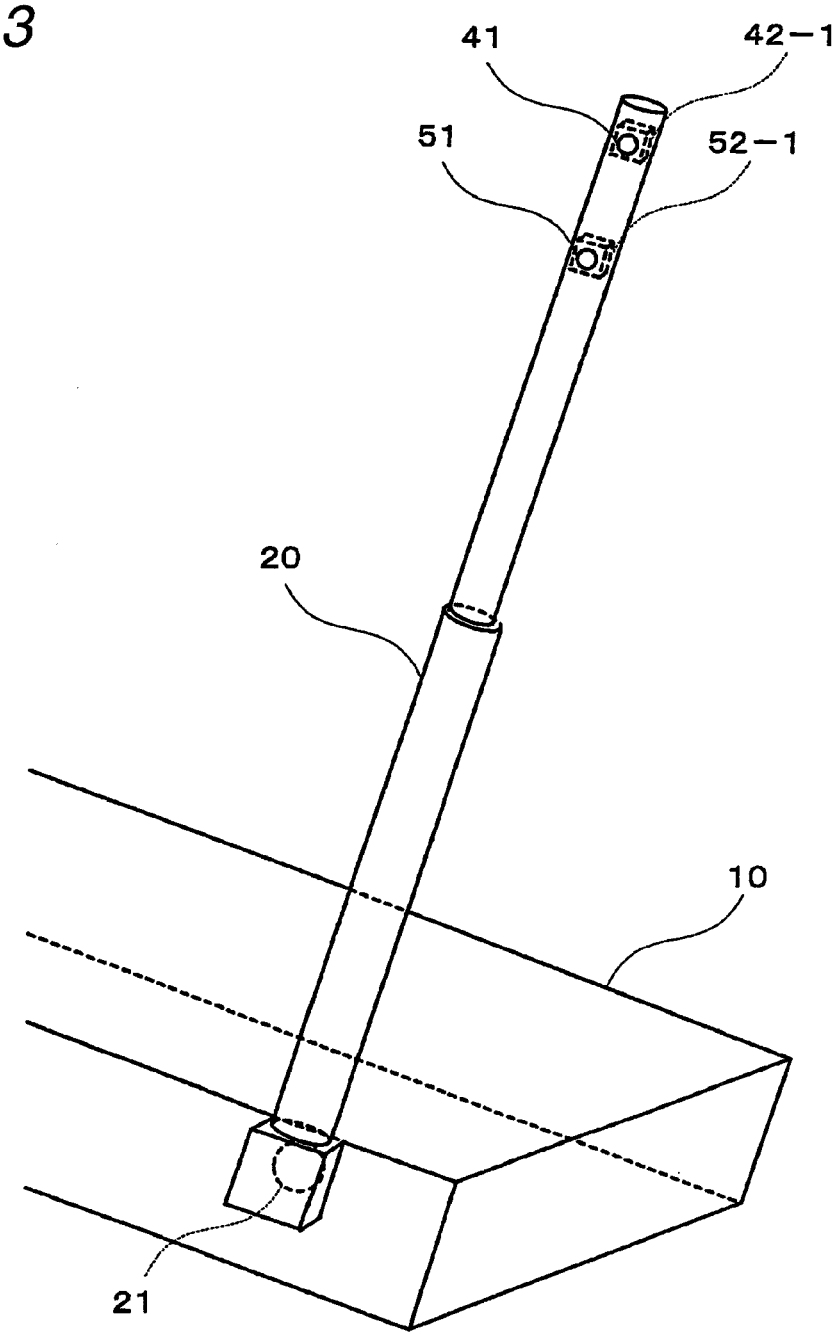
FIG. 3 is a diagram for indicating another example as to a construction of a voice input apparatus according to the present embodiment mode.
Figure 4:
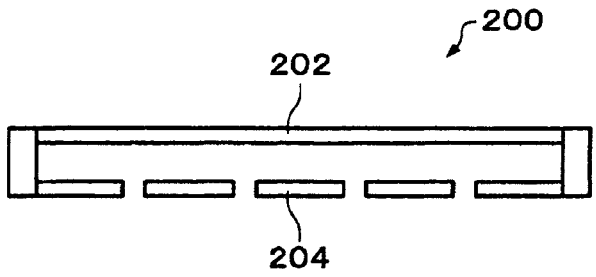
FIG. 4 is a diagram for representing a structural example of a condenser type microphone.

FIG. 3 is a perspective view for showing one example of the microphone holding unit 20 according to the present embodiment mode, the portion of which has been enlarged.

In the present embodiment mode, both the first sound hole 41 and the first vibration plate 42 have been provided in the microphone holding unit 20. Also, the second sound hole 51 and the second vibration plate 52 have been provided in the microphone holding unit 20. It should also be understood that the first vibration plate 42 has been provided at a first vibration plate position 42-1, and the second vibration plate 52 has been provided at a second vibration plate position 52-1.

The first sound hole 41 and the second sound hole 51 are such holes which constitute corresponding sound collecting holes of the first microphone 40 and the second microphone 50, respectively, and are such holes which connect the first vibration plate 42 and the second vibration plate 52 to an external space, respectively. No specific limitation is made as to shapes of opening planes of the first sound hole 41 and the second sound hole 51, and therefore, these shapes of the opening planes may be formed in, for example, a rectangular shape, a polygon shape, or a circular shape, respectively. In the present embodiment mode, the shapes of the opening planes of the first sound hole 41 and the second sound hole 51 have been made in the circular shapes.

The first vibration plate 42 and the second vibration plate 52 are such members which are vibrated along a normal direction when sound waves are entered to the first and second vibration plates 42 and 52. Then, in the voice input apparatus 1, since electric signals are extracted based upon vibrations of the first vibration plate 42 and the second vibration plate 52, electric signals are acquired which indicate voices entered to the first vibration plate 42 and the second vibration plate 52. In other words, both the first vibration plate 42 and the second vibration plate 52 are vibration plates of microphones.

Next, a description is made of a structure of a condenser type microphone 200 as one example of a microphone which can be applied to the present embodiment mode. FIG. 3 is a sectional view for schematically showing the structure of the condenser type microphone 200.

The condenser type microphone 200 has a vibration plate 202. It should also be noted that the above-explained vibration plate 202 corresponds to the vibration plate 22 of the voice input apparatus 1 according to the present embodiment mode. The vibration plate 202 is such a film (thin film) which is vibrated by receiving sound waves, and has an electric conducting characteristic, while the vibration plate 202 has constituted one edge of an electrode 204. Also, the condenser type microphone 200 has the electrode 204. The electrode 204 has been arranged opposite to the vibration plate 202 in the vicinity of the vibration plate 202. As a result, both the vibration plate 202 and the electrode 204 form a capacitance. When sound waves are entered to the condenser type microphone 200, the vibration plate 202 is vibrated, so that an interval between the vibration plate 202 and the electrode 204 is changed, and thus, a static capacitance between the vibration plate 202 and the electrode 204 is changed. Since this change in the static capacities is derived as, for example, a change in voltages, electric signals produced based upon the vibrations of the vibration plate 202 can be acquired. In other words, the sound waves which are entered to the condenser type microphone 200 can be converted to the electric signals, and then, the electric signals can be outputted therefrom. It should also be noted that in the condenser type microphone 200, the electrode 204 may be alternatively formed by having such a structure which cannot be influenced by the sound waves. For instance, the electrode 204 may be alternatively formed in a mesh structure.

It should also be noted that a microphone which can be applied to the present invention is not limited only to a condenser type microphone, but any one of microphones which have already been known in the technical field may be applied. For instance, the first vibration plate 42 and the second vibration plate 52 maybe realized by utilizing vibration plates of various sorts of microphones, namely, vibration plates of a dynamic type microphone, an electromagnetic type microphone, a piezoelectric (crystal) type microphone, or the like.

Alternatively, the first vibration plate 42 and the second vibration plate 52 may be realized by employing semiconductor films (for example, silicon films). In other words, the first vibration film 42 and the second vibration plate 52 may be realized by employing vibration plates of a silicon microphone (Si microphone). Since such a silicon microphone is utilized, the voice input apparatus 1 may be made compact and high performance of the voice input apparatus 1 may be realized.

It should also be noted that no specific limitation is made as to the shapes of the first vibration plate 42 and the second vibration plate 52. In the present embodiment mode, the vibration planes (vibration surfaces) of the first vibration plate 42 and the second vibration plate 52 are made in circular shapes. Alternatively, for example, the vibration plates of the first and second vibration plates 42 and 52 may be formed in rectangular shapes, polygon shapes, or ellipsoidal shapes.

The voice input apparatus 1, according to the present embodiment mode, contains the signal processing unit 60. The signal processing unit 60 performs a signal processing operation based upon an output of the first microphone 40 and an output of the second microphone 50. In the present embodiment mode, the signal processing unit 60 performs the signal processing operation including such a process operation for producing a difference signal between an output signal of the first microphone 40 and an output signal of the second microphone 50. In other words, the voice input apparatus 1 utilizes the first microphone 40 and the second microphone 50 as a differential microphone. It should be understood that in the present embodiment mode, the signal processing unit 60 has been provided inside the main body 10, which is not shown in the drawing.

In the voice input apparatus 1 according to the present embodiment mode, as to a distance between the first sound hole 41 and the second sound hole 51, this distance between the first sound hole 41 and the second sound hole 52 may be alternatively set to such a distance that with respect to sounds of a preselected frequency range, a phase component of a voice strength ratio becomes lower than, or equal to 0 dB, while the above-described voice strength ratio corresponds to a ratio of a strength of a voice component contained in difference sound pressure of voices which are entered to the first sound hole 41 and the second sound hole 51 with respect to a strength of sound pressure as to the voice entered to the first sound hole 41. The predetermined frequency range may be selected as such a frequency range lower than, or equal to 7 KHz. For example, the first and second sound holes 41 and 51 maybe provided at such a position that the distance between the first sound hole 41 and the second sound hole 51 may become shorter than, or equal to 8.1 mm. Alternatively, the distance between the first sound hole 41 and the second sound hole 51 may be defined as such a distance between a representative point which has been virtually determined within an opening plane of the first sound hole 41 and another representative point which has been virtually determined within an opening plane of the second sound hole 51. For instance, the distance between the first sound hole 41 and the second sound hole 52 may be alternatively set to such a distance between a center point of the opening plane of the first sound hole 41 and another center point of the opening plane of the second sound hole 51.

As a consequence, while the user views the display screen, the user can use the voice input apparatus 1. In particular, such a voice input apparatus can be realized that in the frequency range lower than, or equal to 7 KHz in which the voice input apparatus 1 is utilized in a speech recognition system and a voice translation system, while this voice input apparatus is capable of suppressing delay distortions, and further, capable of suppressing surrounding noise propagated from the omnidirection fields. It should also be noted that these effects will be later discussed in detail.

Figure 5:
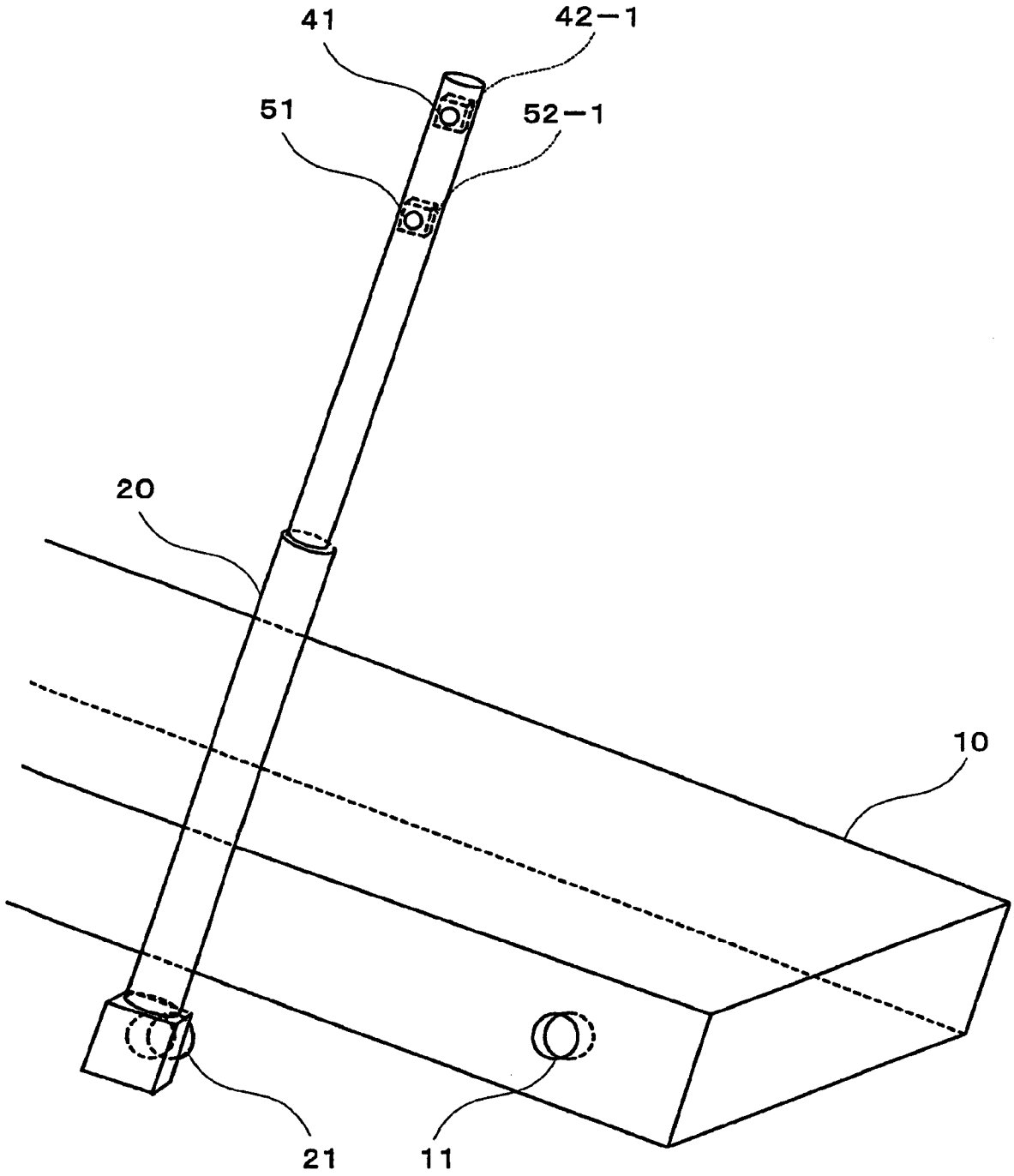
FIG. 5 is a diagram for showing a structural example as to the voice input apparatus according to the present embodiment mode.

It should also be noted that the microphone holding unit 20 may be constructed in a detachable manner. FIG. 5 is a perspective view for indicating such a condition that the microphone holding unit 20 has been disconnected from the main body unit 10. In the present embodiment mode, while the main body unit 10 is equipped with a mounting hole 11, a mounting unit 21 of the microphone holding unit 20 is inserted into the mounting hole 11, so that the microphone holding unit 20 can be mounted on the main body unit 10.

Also, in this case, the signal processing unit 60 may alternatively contain a mounting/dismounting judging unit 61 for judging mounting/dismounting situations of the microphone holding unit 20. In such a case that the mounting/dismounting judging unit 61 judges that the microphone holding unit 20 is present, the signal processing unit 60 may alternatively perform a signal processing operation based upon the output signal derived from the first microphone 40 and also the output signal derived from the second microphone 50.

It should also be noted that while the voice input apparatus 1 may be alternatively equipped with a mounting/dismounting detecting unit 65 for detecting mounting/dismounting situations of the microphone holding unit 20, the mounting/dismounting judging unit 61 may alternatively judge the mounting/dismounting situations of the microphone holding unit 20 based upon a detection result made by the mounting/dismounting detecting unit 65. The mounting/dismounting detecting unit 65 may be alternatively arranged by employing, for example, a switch.

With employment of the above-described structure, even when the microphone holding unit 20 has not been mounted on the main body unit 10, if the main body unit 10 has another microphone, then the resulting apparatus may be operated as a voice input apparatus having a normal function.

Also, the voice input apparatus 1 according to the present embodiment mode may be alternatively used in such a manner that this voice input apparatus 1 is used at a position by the display unit 30, in which a distance between the first sound hole 41 and a sound source predicted position becomes shorter than, or equal to 90 mm. The sound source predicted position may be alternatively determined as, for instance, a position of a mouth of a speaker.

With employment of the above-described structure, in addition to such an effect achieved by the voice input apparatus that the delay distortion can be suppressed and the surrounding noise generated from the omnidirectional field can be suppressed, this voice input apparatus capable of maintaining a sensitivity higher than, or equal to a predetermined sensitivity value may be realized. It should also be understood that these effects will be later explained in detail.

Figure 6:
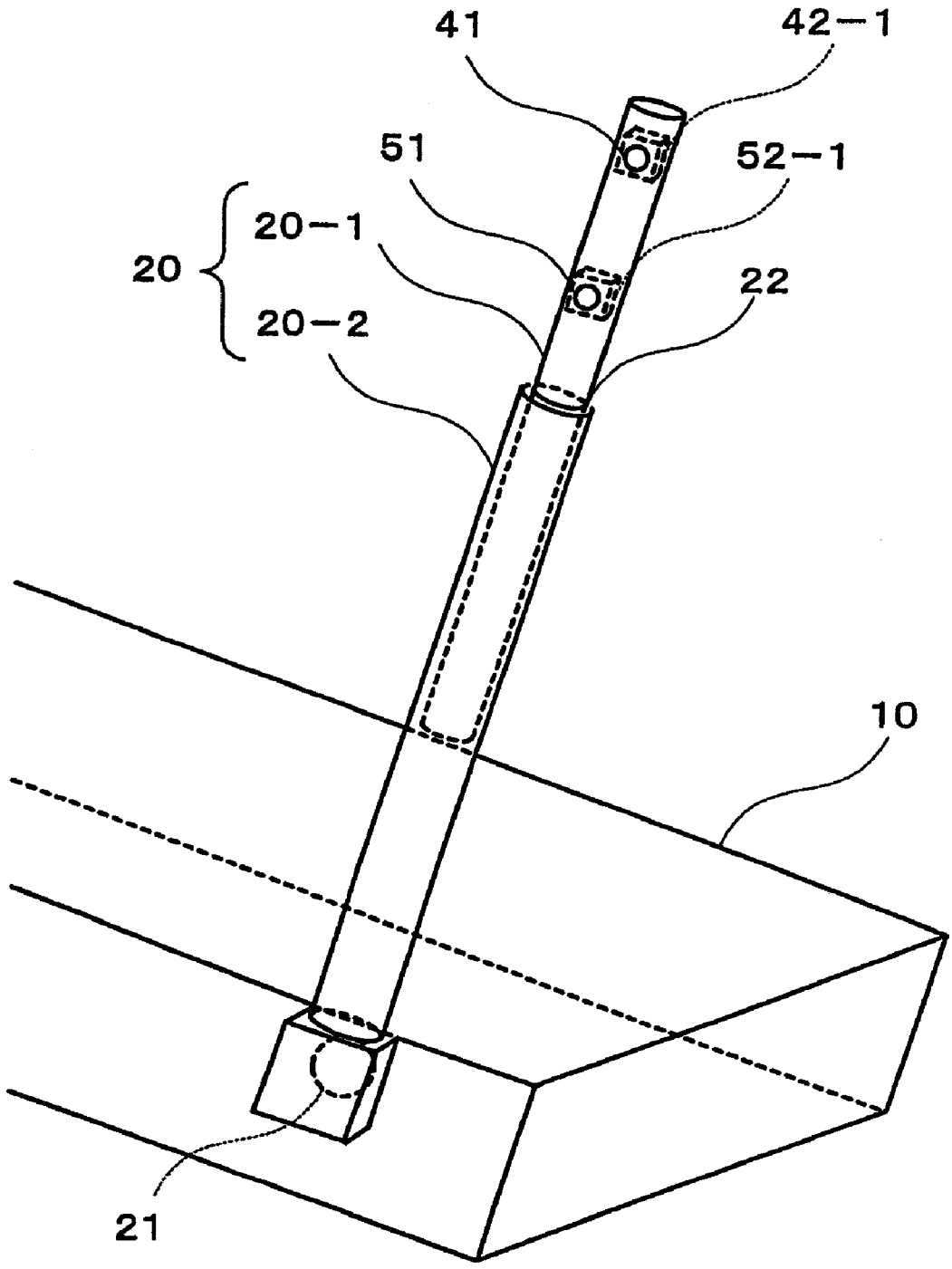
FIG. 6 is a diagram for indicating another structural example as to the voice input apparatus according to the present embodiment mode.

Furthermore, the microphone holding unit 20 may be alternatively constructed in such a manner that the distance and the direction between the first sound hole 41 and the sound source predicted position are adjustable by utilizing at least one of pivotal movement, telescopic movement, and deforming movement. FIG. 6 is a perspective view for showing one example as to such a case that since the microphone holding unit 20 is moved in a telescopic manner while a telescopic moving unit 22 is defined as a boundary, the distance between the first sound hole 41 and the sound source predicted position can be adjusted.

The microphone holding unit 20 shown in FIG. 6 has been constructed of a first microphone holding member 20-1 and a second microphone holding unit 20-2. While the second microphone holding member 20-2 has been made in a cylindrical shape, the first microphone holding member 20-1 has been inserted inside the second microphone holding member 20-2. Also, both the first sound hole 41 and the second sound hole 51 have been provided in the first microphone holding member 20-1.

With employment of the above-described structure, the user can adjust a distance and a direction between the sound source predicted position and the sound holes 41 and 51. Also, since the microphone holding unit 20 holds the distance between the first sound hole 41 and the second sound hole 51, the user can adjust the distance and the direction between the sound source predicted position and the sound holes 41 and 51 without changing the characteristic of the differential microphone which is constituted by the first microphone 40 and the second microphone 50.

In addition to the above-described arrangement, the signal processing unit 60 may alternatively perform a beam forming process operation for processing a predetermined angle range, while a predetermined direction is employed as a reference direction. For instance, in such a case that the first sound hole 41 is located close to the sound source predicted position, as compared with the second sound hole 51, the signal processing unit 60 performs a signal processing operation in such a manner that an amplification factor with respect to the output signal of the first microphone 40 is furthermore increased, as compared with an amplification factor as to the output signal of the second microphone 50. As a result, the signal processing unit 60 may increase a sensitivity with respect to voices transferred from a predetermined angle range which has been set by defining a direction from the second sound hole 51 to the first sound hole 41 as the reference direction.

Alternatively, the signal processing unit 60 may be further equipped with a switching process unit 62 for switching whether or not a beam forming process operation is required. For instance, the switching process unit 62 may switch whether or not the beam forming process operation is required based upon an operation by the user.

Also, while the signal processing unit 60 may alternatively contain a microphone sensitivity detecting unit 63, the switching process unit 62 may alternatively switch whether or not the beam forming process operation is required based upon a detection result of the microphone sensitivity detecting unit 63. For instance, only when a microphone sensitivity becomes lower than, or equal to a threshold sensitivity level, the switching process unit 62 may alternatively perform the beam forming process operation.

As previously described, in such a case that the sensitivity of the voice input apparatus 1 becomes short, the beam forming process operation is carried out in a complementary manner in addition to the characteristic of the differential microphone, so that the noise can be suppressed, and moreover, the shortage of the sensitivity can be solved.

In addition, the signal processing unit 60 may alternatively fix a direction along which a beam forming process operation is carried out to such a direction directed from the second sound hole 51 to the first sound hole 41. More specifically, when the microphone holding unit 20 has been constructed in such a manner that both the distance and the direction between the sound source predicted position and the first sound hole 41 can be adjusted based upon at least one of the pivotal movement, the telescopic movement, and the deforming movement, it is predictable that the user adjusts the microphone holding unit 20 toward his mouth. As a result, the direction along which the beam forming process operation is carried out can be set in such a manner that the above-described direction is fixed to another direction directed from the second sound hole 51 to the first sound hole 41.

As previously explained, the direction along which the beam forming process operation has been previously determined, so that an amount of signal processing operations executed by the signal processing unit 60 can be reduced.

In the above-described voice input apparatus 1, since the microphone holding unit 20 is moved in the telescopic manner while the telescopic moving unit 22 is set as the boundary, the distance between the first sound hole 41 and the sound source predicted position can be adjusted, and the microphone holding unit 20 has been constructed so as to adjust the distance between the first sound hole 41 and the second sound hole 51. Alternatively, the microphone holding unit 20 maybe constructed in such a manner that this microphone holding unit 20 may adjust the distance between the first sound hole 41 and the second sound hole 51.

Figure 7:
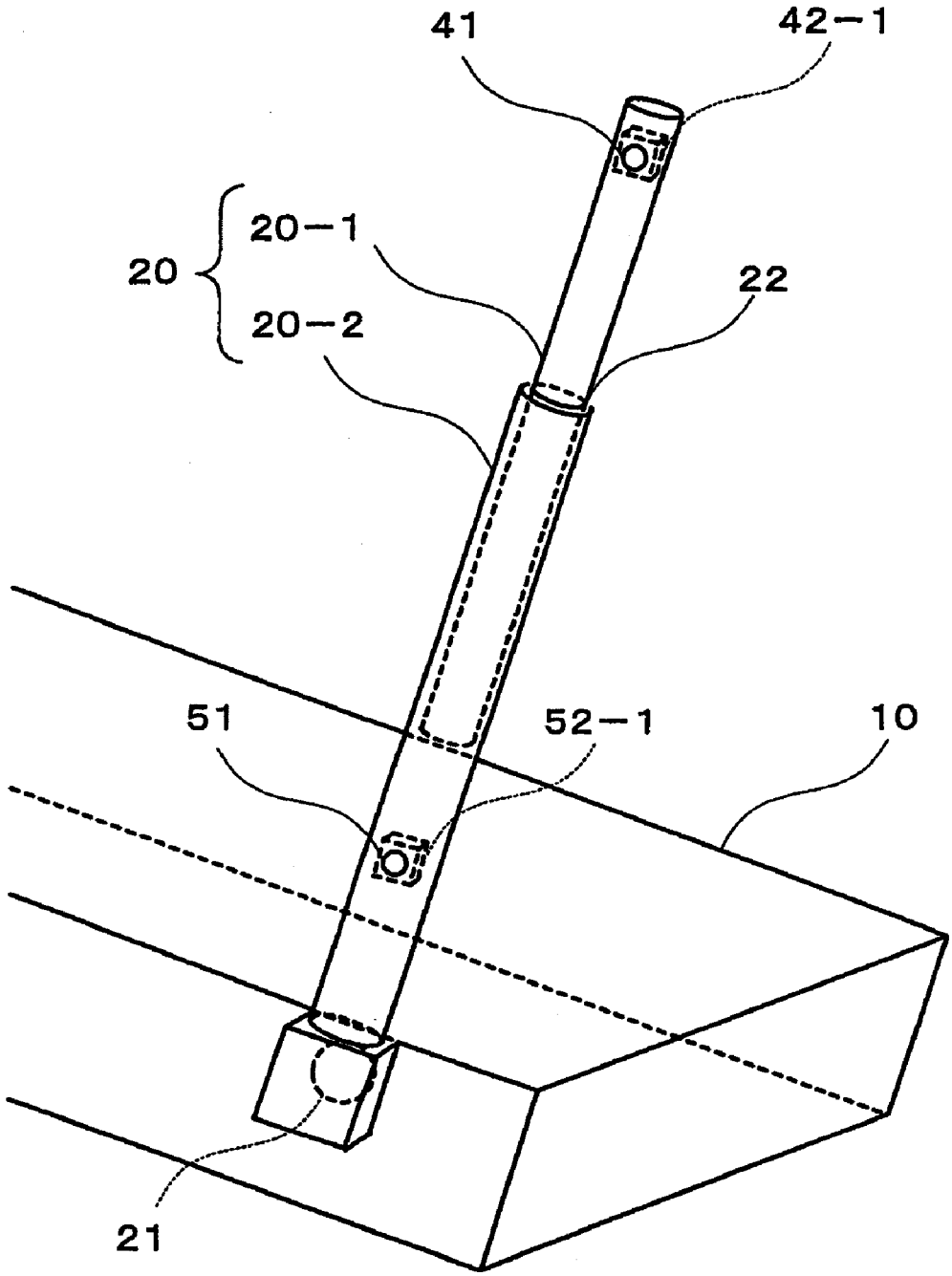
FIG. 7 is a diagram for indicating another structural example as to the voice input apparatus according to the present embodiment mode.

FIG. 7 is a perspective view for showing one example of the microphone holding unit 20, which has been enlarged, in such a case that the microphone holding unit 20 has been constructed in such a manner that the distance between the first sound hole 41 and the second sound hole 51 can be adjusted. In the present embodiment mode, the first sound hole 41 has been formed in the microphone holding member 20-1, and the second sound hole 51 has been formed in the second microphone holding member 20-2. In other words, since the first sound hole 41 and the second sound hole 51 are formed in positions which sandwich the telescopic moving unit 22, the distance between the first sound hole 41 and the second sound hole 51 may be adjusted.

With employment of the above-explained structure, the characteristic of the differential microphone constituted by employing the first microphone 40 and the second microphone 50 can be adjusted in response to a requirement made by the user.

Figure 8:
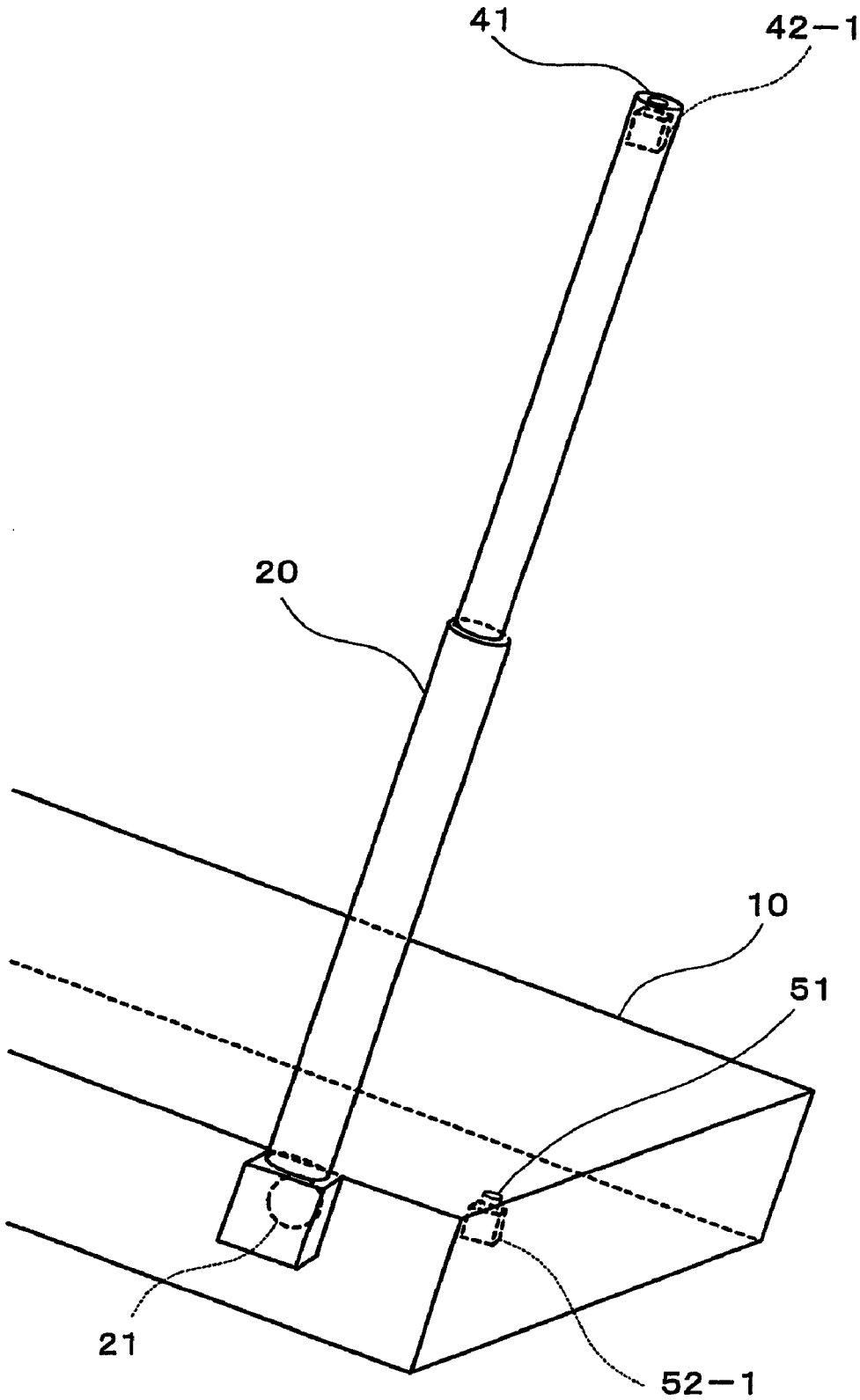
FIG. 8 is a diagram for indicating another structural example as to the voice input apparatus according to the present embodiment mode.

In the above-described voice input apparatus 1, both the first sound hole 41 and the second sound hole 51 have been provided in the microphone holding unit 20. Another structure may be similarly constructed in such a manner that the first sound hole 41 maybe formed in the microphone holding unit 20, whereas the second sound hole 51 may be formed in the main body unit 10. FIG. 8 is a perspective view for showing the microphone unit 20 in an enlargement manner in such a case that the first sound hole 41 is formed in the microphone holding unit 20, and the second sound hole 51 is formed in the main body unit 10.

For instance, when a microphone has been provided on the main body unit 10 of such an electric appliance as a portable telephone, a sound hole of this microphone provided on the main body unit 10 may be utilized as the above-described second sound hole 51.

In the above-explained voice input apparatuses 1 and 2, two sets of the vibration plates 42 and 52 have been provided, namely, the first vibration plate 42 corresponding to the first microphone 40, and the second vibration plate 52 corresponding to the second microphone 50 have been provided. Alternatively, both the first microphone 40 and the second microphone 50 may commonly have a single vibration plate. In other words, the first microphone 40 may be alternatively constructed by containing the first sound hole 41 and a commonly-used vibration plate 45, whereas the second microphone 50 maybe alternatively arranged by containing the second sound hole 51 and the commonly-used vibration plate 45.

Figure 9:
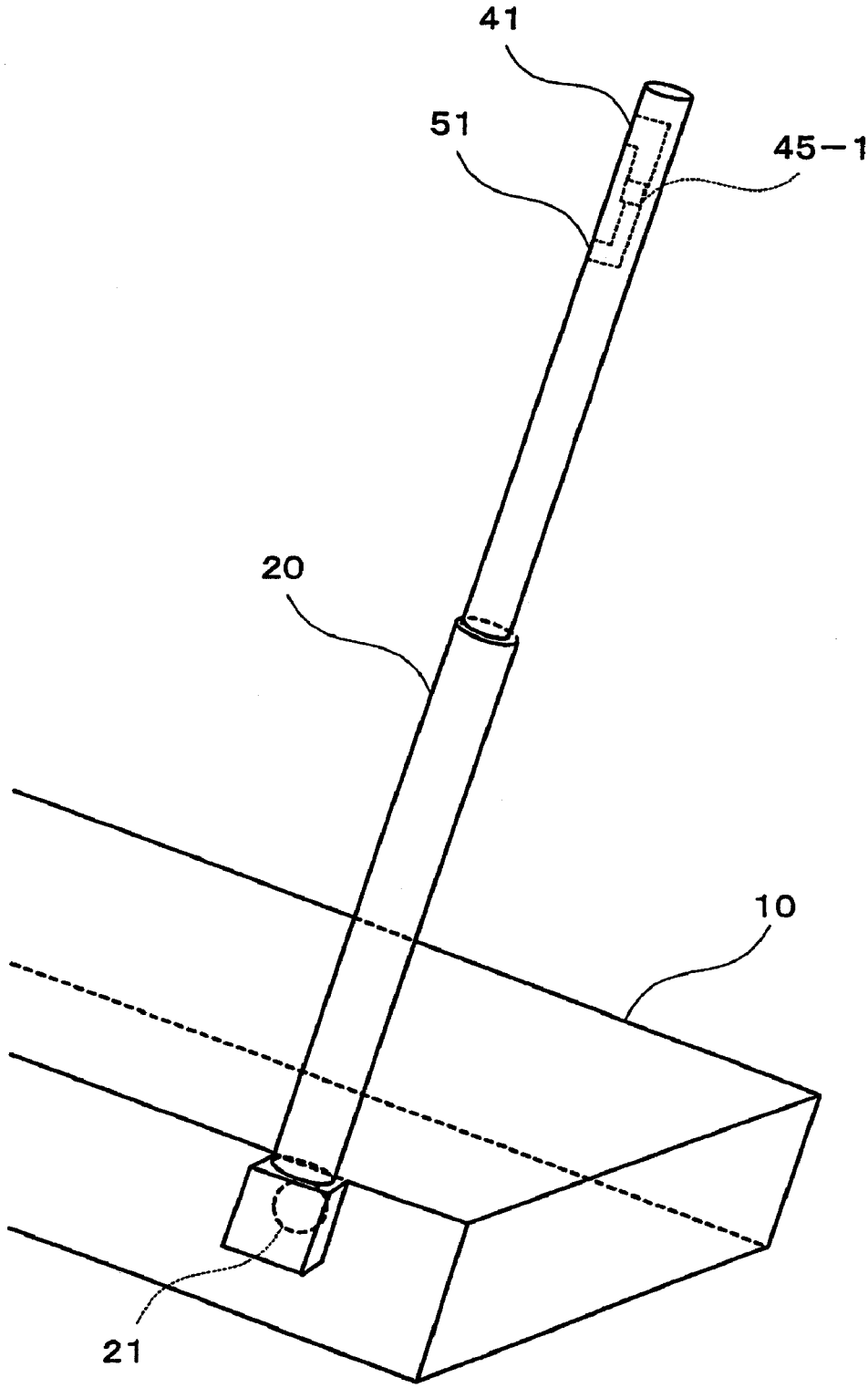
FIG. 9 is a diagram for indicating another structural example as to the voice input apparatus according to the present embodiment mode.

FIG. 9 is a front view for showing a voice input apparatus 3 in which both the first microphone 40 and the second microphone 50 commonly use a single commonly-used vibration plate 45 (not shown). While the commonly-used vibration plate 45 is provided inside the microphone holding unit 20, the first sound hole 41 is communicated to one plane of the commonly-used vibration plate 45, and the second sound hole 51 is communicated to the other plane of the commonly-used vibration plate 45. It should also be noted that the commonly-used vibration plate 45 has been provided at a vibration plate position 45-1.

Figure 10A:
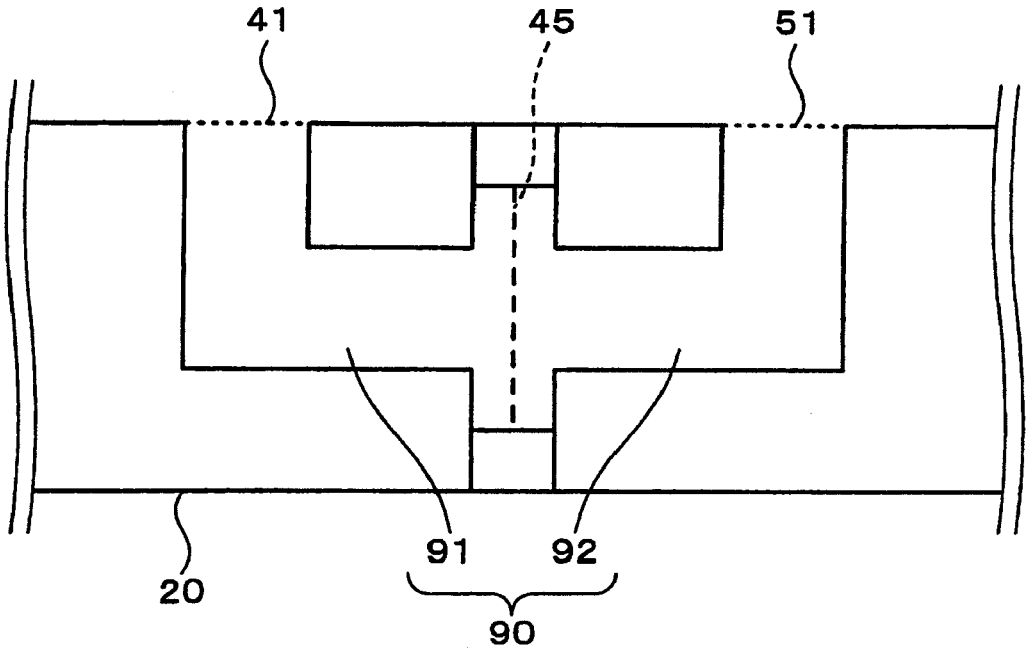
FIGS. 10A and 10B are diagrams for indicating another structural example as to the voice input apparatus according to the present embodiment mode.
Figure 10B:
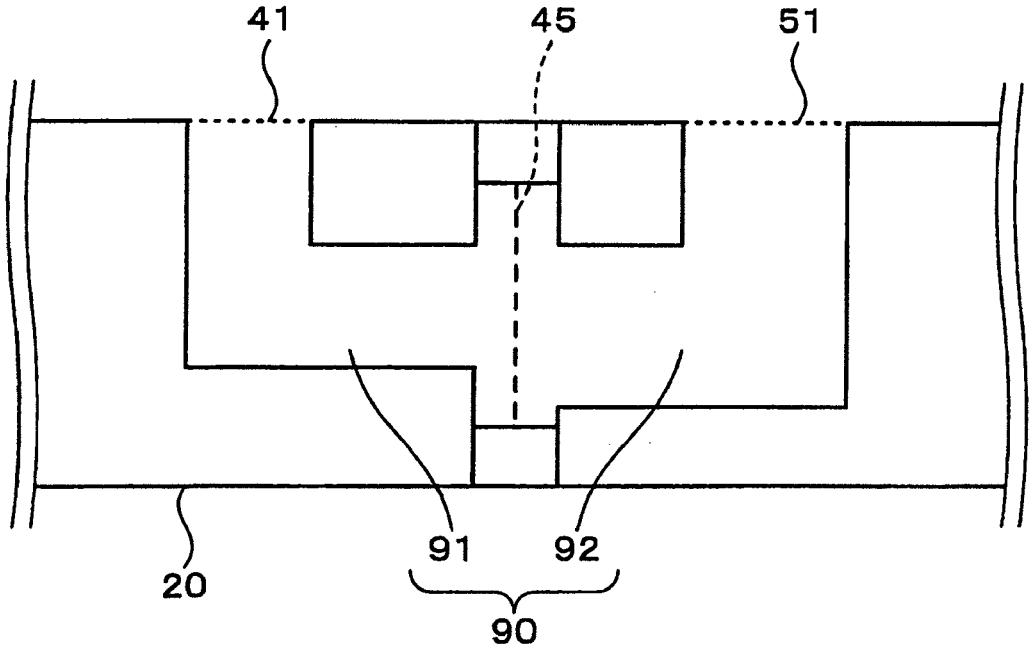

FIG. 10A and FIG. 10B are sectional views for schematically representing a relationship among the first sound hole 41, the second sound hole 51, and the commonly-used vibration plate 45.

In FIG. 10A, while the microphone holding unit 20 has an internal space 90, the internal space 90 has been segmented to a first internal space 91 and a second internal space 92 by the commonly-used vibration plate 45. The first internal space 91 is communicated via the first sound hole 41 with an external space. Also, the second internal space 92 is communicated via the second sound hole 51 with the external space.

In the present embodiment mode, the commonly-used vibration plate 45 receives sound pressure from both sides thereof. As a consequence, when two sets of sound pressure having the same magnitudes are applied to both sides of the common-used vibration plate 45 at the same time, these two sets of sound pressure are canceled with each other on the commonly-used vibration plate 45, so that these two sets of sound pressure do not constitute such a force capable of vibrating the commonly-used vibration plate 45. Conversely speaking, when there is a difference between two sets of sound pressure received by both sides of the commonly-used vibration plate 45, this commonly-used vibration plate 45 is vibrated based upon the sound pressure difference.

Also, sound pressure of sound waves entered to the first sound hole 41 and sound pressure of sound waves entered to the second sound hole 51 are equally propagated to an internal wall plane of the first internal space 91 and an internal wall plane of the second internal space 92 (namely, Pascal's principle) As a consequence, a plane of the commonly-used vibration plate 45, which is directed to the first internal space 91, receives such a sound pressure which is equal to the sound pressure entered to the first sound hole 41, whereas a plane of the commonly-used vibration plate 45, which is directed to the second internal space 92, receives such a sound pressure which is equal to the sound pressure entered to the second sound hole 51.

In other words, the commonly-used vibration plate 45 is vibrated in response to the difference between the sound pressure of the sound waves entered to the first sound hole 41, and the sound pressure of the sound waves entered to the second sound hole 51.

As a consequence, the commonly-used vibration plate 45 outputs such a difference between the sound pressure inputted from the first sound hole 41 and the sound pressure inputted from the second sound hole 51. In other words, a differential microphone has been constructed by employing the first sound hole 41, the second sound hole 51, and the commonly-used vibration plate 45.

In FIG. 10A, although a sectional area of the first sound hole 41 has been made equal to a sectional area of the second sound hole 51, a sectional area of the second sound hole 51 may be formed larger than a sectional area of the first sound hole 41, as shown in FIG. 10B.

For example, in such a case that the second sound hole 51 is located close to the sound source predicted position, as compared with the first sound hole 41, the sectional area of the second sound hole 51 is made larger than the sectional area of the first sound hole 41, for instance, a diameter of the second sound hole 51 is made larger than, or equal to 0.3 mm, whereas a diameter of the first sound hole 41 is made smaller than 0.3 mm. As a result, a sensitivity with respect to voices propagated from a predetermined angle range can be increased, and the above-described angle range has been set while the direction from the first microphone 40 toward the second microphone 50 is defined as the reference direction.

Further, in addition to the sectional area of the first sound hole 41 and the sectional area of the second sound hole 51, a volume as to an internal space of the first sound hole 41 is made equal to a volume as to an internal space of the second sound hole 51, and a path length defined from the opening plane of the first sound hole 41 to the commonly-used vibration plate 45 is made equal to a path length defined from the opening plane of the second sound hole 51 to the commonly-used vibration plate 45, so that an ideal differential characteristic can be obtained. Also, since the volumes as to the internal spaces of the first sound hole 41 and the second sound hole 51 are made as small as possible, and the path lengths defined from the opening planes of the first and second sound holes 41 and 51 are made as short as possible, a resonant frequency of sound pressure from each of the first and second sound holes 41 and 51 can be shifted to the side of a high frequency range. Therefore, a flat frequency characteristic can be secured over a wide frequency range, so that such a differential microphone having high performance can be obtained.

On the other hand, the volume as to the internal space (first internal space 91) of the first sound hole 41 is made different from the volume as to the internal space (second internal space 92) of the second sound hole 51, or a path length defined from the opening plane of the first sound hole 41 to the commonly-used vibration plate 45 is made different from a path length defined from the opening plane of the second sound hole 51 to the commonly-used vibration plane 45, so that the sensitivity can be increased with respect to the voices propagated from the predetermined angle range set by defining the direction from the first microphone 40 to the second microphone 50 as the reference direction.

A path length defined from an opening area of a sound hole to the commonly-used vibration plate 45 may be alternatively defined as, for example, a length of a line which connects centers of sectional areas of the sound holes to each other.

Figure 11:
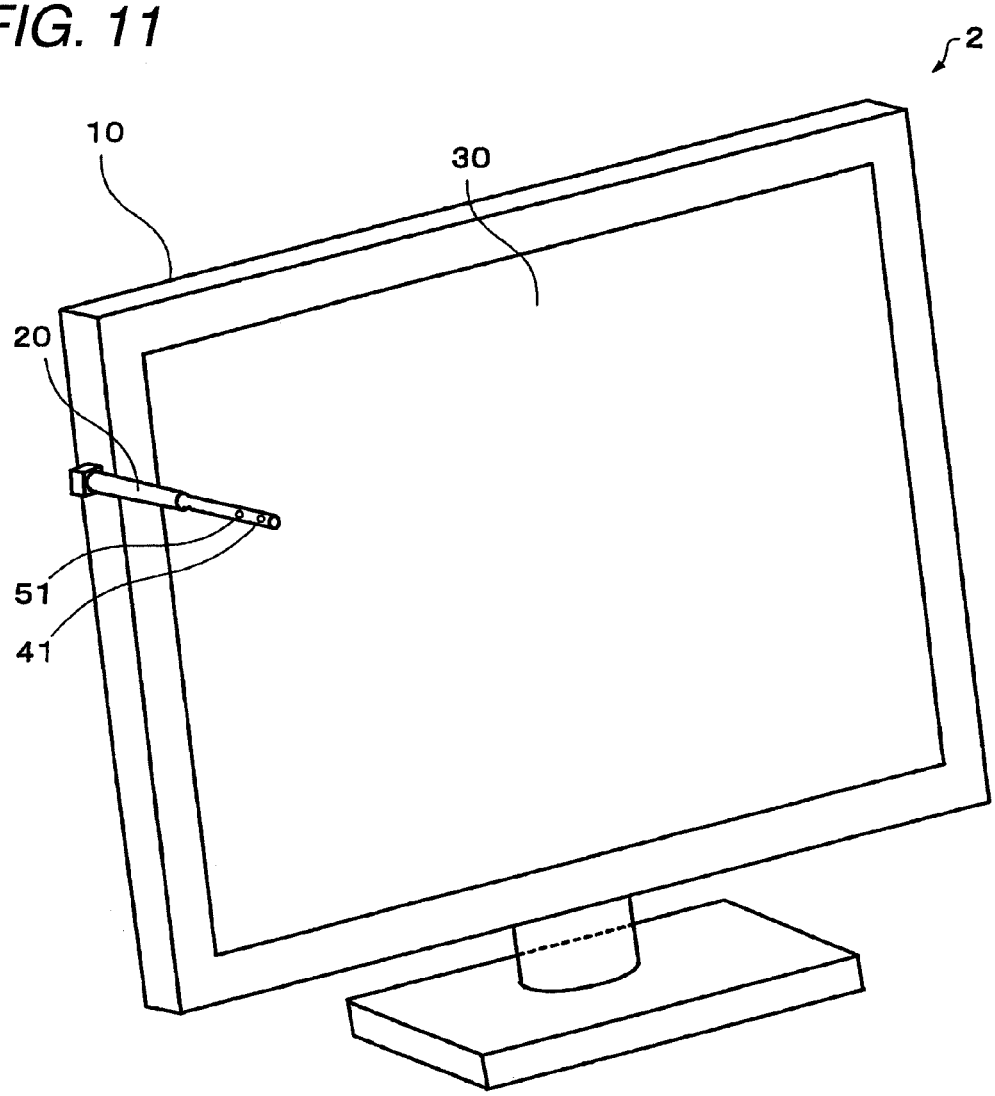
FIG. 11 is a diagram for indicating a further structural example as to the voice input apparatus according to the present embodiment mode.

The above-described voice input apparatus 1 has been exemplified by employing the portable telephone. Alternatively, the present invention is not limited only to such a portable telephone, but may be applied to, for example, a desktop type personal computer. FIG. 11 is a perspective view of a voice input apparatus 2 in such a case that the main body unit 10 corresponds to a monitor of a desktop type personal computer.

It should be noted that in this alternative case, the output interface 70 may be provided in the microphone holding unit 20. The output interface 70 may be connected to a main body (corresponding to other processing circuits) of the desktop type personal computer by employing electrodes, connectors, cables, and the like. Alternatively, the output interface 70 may be communicated with the main body (corresponding to other processing circuits) of the desktop type personal computer by utilizing a wireless communication manner.

While sound waves are traveled through a medium, the sound waves are attenuated, so that sound pressure (strengths/amplitudes of sound waves) is lowered. Since sound pressure is in inverse proportion to a distance which is measured from a sound source, sound pressure "P" can be expressed based upon a relationship between the sound pressure "P" and a distance "R" measured from the sound source by the below-mentioned formula:

$$P = K\frac{1}{R} \tag{1}$$

Figure 12:
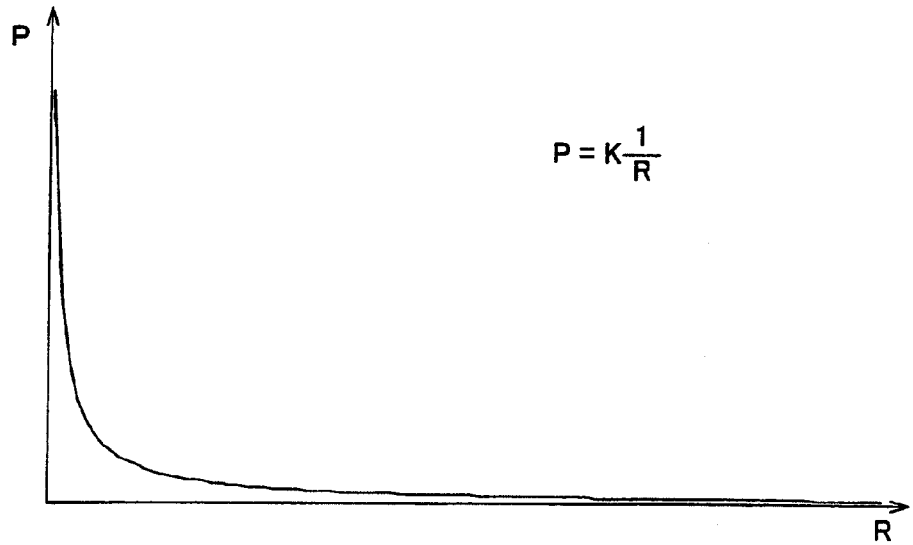
FIG. 12 is an explanatory diagram for explaining an attenuation characteristic of sound waves.

It should be understood that symbol "K" expressed in the formula (1) is a proportional constant. FIG. 12 is a graph for representing the above-explained formula (1). As can also be understood from this graphic representation, the sound pressure (amplitude of sound waves) is rapidly attenuated at a position (namely, left side of graph) closer to the sound source, and then, is gently attenuated, as the present position is separated from the sound source.

In such a case that the voice input apparatus 1 is utilized as a close-talking type voice input apparatus, voices of a user are generated in the vicinity of the first sound hole 41 and the second sound hole 51. As a result, the voices of the user are largely attenuated between the first sound hole 41 and the second sound hole 51, so that a large difference appears between sound pressure of the user voices entered to the first sound hole 41 and sound pressure of the user voices entered to the second sound hole 51.

In contrast to the user voices, as to noise components, a sound source is present at a far position separated from the first and second sound holes 41 and 51, as compared with the voices of the user. As a consequence, sound pressure of the noise is not substantially attenuated between the first sound hole 41 and the second sound hole 51, so that a substantially no difference appears between the sound pressure of the noise entered to the first sound hole 41 and the sound pressure of the noise entered to the second sound hole 51.

As a consequence, in accordance with the voice input apparatus 1 according to the present embodiment mode, it is possible to provide such a voice input apparatus capable of acquiring an electric signal indicative of user voices from which noise components have been eliminated based upon a characteristic of a differential microphone.

It should also be understood that a similar effect may be similarly achieved in the above-described voice input apparatuses 2 and 3.

As previously explained, in accordance of the voice input apparatus 1 of the present embodiment mode, the electric signals indicative of only the voices of the user from which the noise components have been eliminated can be acquired based upon the characteristic of the differential microphone. However, it should be understood that the sound waves contain phase components. As a consequence, if a delay distortion caused by such a phase difference between sound waves entered to the first sound hole 41 and the second sound hole 51 is considered, then such a voice input apparatus capable of realizing a noise eliminating function in higher precision can be designed. Now, a description is made of conditions which should be satisfied by the voice input apparatus 1 in order to realize the noise eliminating function in higher precision. It should also be noted that similar conditions maybe similarly established with respect also to the voice input apparatuses 2 and 3.

In accordance with the voice input apparatus 1 which utilizes the characteristic of the differential microphone, it is possible to evaluate that the noise eliminating function thereof can be realized by establishing such a fact that noise components contained in a difference between sound pressure entered to the first sound hole 41 and sound pressure entered to the second sound hole 51 (namely, differential sound pressure) become smaller than noise components contained in the sound pressure entered to the first sound hole 41 and the sound pressure entered to the second sound hole 51. Precisely speaking, it is possible to evaluate that the above-explained noise eliminating function can be realized if a noise strength ratio becomes smaller than a user voice strength ratio. The above-described noise strength ratio indicates such a ratio of a strength of the noise components contained in the differential sound pressure with respect to a strength of the noise components contained in the sound pressure entered to the first and second sound holes 41 and 51, whereas the above-explained user voice strength ratio indicates such a ratio of a strength of user voice components contained in the differential sound pressure with respect to a strength of user voice components contained in the sound pressure entered to the first and second sound holes 41 and 51.

Next, a description is made of concrete conditions which should be satisfied by the voice input apparatus 1 in order to realize the above-described noise eliminating function.

First of all, sound pressure of voices which are entered to the first sound hole 41 and the second sound hole 51 will now be considered. Assuming now that a instance defined from a sound source of a user voice up to the first sound hole 41 is "R", and also, a distance between centers of the first and second sound holes 41 and 51 is "Δr", if a phase difference is neglected, then sound pressure (strength) "P(S1)" of a user voice which is entered to the first sound hole 41, and also, sound pressure (strength) "P(S2)" of a user voice which is entered to the second sound hole 51 can be expressed by the below-mentioned formula:

$$\begin{cases} P(S1) = K\frac{1}{R} & (2) \\ P(S2) = K\frac{1}{R+\Delta r} & (3) \end{cases}$$

As a consequence, a user voice strength ratio "ρ(P)" indicative of such a ratio of a strength of user voice components contained in differential sound pressure with respect to a strength of sound pressure of a user voice entered to the first sound hole 41 when the phase difference of the user voices is neglected can be expressed by the below-mentioned formula:

$$\rho(P) = \frac{P(S1) - P(S2)}{P(S1)} = \frac{\Delta r}{R+\Delta r} \quad (4)$$

In this case, in such a case that the above-explained voice input apparatus 1 is used as a close-talking type voice input apparatus, the center-to-center distance "Δr" may be regarded as such a fact that this distance "Δr" is sufficiently shorter than the above-explained distance "R."

As a consequence, the above-explained formula (4) can be modified to become the below-mentioned formula:

$$\rho(P) = \frac{\Delta r}{R} \quad (A)$$

That is, it can be understood that the user voice strength ratio in such a case that the phase difference of the user voices is neglected may be expressed as the above-explained formula (A).

On the other hand, if the phase difference of the user voices is considered, then sound pressure "Q(S1)" and "Q(S2)" of the user voices can be expressed by the below-mentioned formulae:

$$\begin{cases} Q(S1) = K\frac{1}{R}\sin\omega t & (5) \\ Q(S2) = K\frac{1}{R+\Delta r}\sin(\omega t - \alpha) & (6) \end{cases}$$

It should be noted that symbol "α" indicates a phase difference in the formula (6).

At this time, a user voice strength ratio "ρ(S)" can be expressed by the below-mentioned formula:

$$\rho(S) = \frac{|P(S1) - P(S2)|_{max}}{|P(S1)|_{max}} = \frac{\left|\frac{K}{R}\sin\omega t - \frac{K}{R+\Delta r}\sin(\omega t - \alpha)\right|_{max}}{\left|\frac{K}{R}\sin\omega t\right|_{max}} \quad (7)$$

When the above-explained formula (7) is considered, a magnitude of the user voice strength ratio "ρ(S)" can be expressed by the below-mentioned formula:

$$\rho(S) = \frac{\frac{K}{R}\left|\sin\omega t - \frac{1}{1+\Delta r/R}\sin(\omega t - \alpha)\right|_{max}}{\frac{K}{R}|\sin\omega t|_{max}} = \frac{1}{1+\Delta r/R}|(1+\Delta r/R)\sin\omega t - \sin(\omega t - \alpha)|_{max} = \frac{1}{1+\Delta r/R}\left|\sin\omega t - \sin(\omega t - \alpha) + \frac{\Delta r}{R}\sin\omega t\right|_{max} \quad (8)$$

In this case, a term of "sin ωt−sin(ωt−α)" contained in the above-explained formula (8) indicates a strength ratio of phase components, and another term of "(Δr/R)·sin ωt" within the formula (8) indicates a strength ratio of amplitude components. Even when the user voice component is present, the phase difference components constitute noise with respect to the amplitude components. As a result, in order to extract user voices in high precision, it is required that the strength ratio of the phase components is sufficiently smaller than the strength ratio of the amplitude components. In other words, it is important that both "sin ωt−sin(ωt−α)" and "(Δr/R)·sin ωt" must satisfy the below-mentioned relationship:

$$\left|\frac{\Delta r}{R}\sin\omega t\right|_{max} > |\sin\omega t - \sin(\omega t - \alpha)|_{max} \quad (B)$$

In this case, $$\sin\omega t - \sin(\omega t - \alpha) = 2\sin\frac{\alpha}{2}\cdot\cos\left(\omega t - \frac{\alpha}{2}\right), \quad (9)$$

since it can be expressed as the formula (9), the above-explained formula (B) can be represented by the below-mentioned formula:

$$\left|\frac{\Delta r}{R}\sin\omega t\right|_{max} > \left|2\sin\frac{\alpha}{2}\cdot\cos\left(\omega t - \frac{\alpha}{2}\right)\right|_{max} \quad (10)$$

When the amplitude component of the above-explained formula (10) is considered, it can be understood that the voice input apparatus 1 according to the present embodiment mode is required to satisfy the below-mentioned conditions:

$$\frac{\Delta r}{R} > 2\sin\frac{\alpha}{2} \quad (C)$$

As previously described, since "Δr" can be regarded as such a fact that "Δr" is sufficiently smaller than the distance "R", "sin(α/2)" can be regarded as such a fact that "sin(α/2)" is sufficiently small, and thus, the below-mentioned approximation may be established:

$$\sin\frac{\alpha}{2} \approx \frac{\alpha}{2} \quad (11)$$

As a consequence, the above-described formula (C) can be modified to become the following formula:

$$\frac{\Delta r}{R} > \alpha \tag{D}$$

Also, if a relationship between "α" and "Δr" corresponding to the phase difference is expressed as $$\alpha = \frac{2\pi\Delta r}{\lambda}, \tag{12}$$

then the above-described formula (D) can be modified to become the below-mentioned formula:

$$\frac{\Delta r}{R} > 2\pi\frac{\Delta r}{\lambda} > \frac{\Delta r}{\lambda} \tag{E}$$

In other words, in the present embodiment mode, if the voice input apparatus 1 can satisfy the above-described relationship expressed in the formula (E), then the user voices can be extracted in higher precision.

Next, sound pressure as to noise entered to the first sound hole 41 and the second sound hole 51 will now be considered.

Assuming now that an amplitude of a noise component entered to the first sound hole 41 is "A", and another amplitude of a noise component entered to the second sound hole 51 is "A'", sound pressure "Q(N1)" and "Q(N2)" of noise in which a phase difference component has been considered can be expressed by the below-mentioned formula:

$$\begin{cases} Q(N1) = A\sin\omega t & (13) \\ Q(N2) = A'\sin(\omega t - \alpha) & (14) \end{cases}$$

Also, a noise strength ratio "ρ(N)" can be expressed by the below-mentioned formula (17), while the noise strength ratio "ρ(N)" indicates a ratio of a strength of noise components contained in differential sound pressure with respect to a strength of sound pressure of noise components which are entered to the first sound hole 41:

$$\rho(N) = \frac{|Q(N1) - Q(N2)|_{max}}{|Q(N1)|_{max}} = \frac{|A\sin\omega t - A'\sin(\omega t - \alpha)|_{max}}{|A\sin\omega t|_{max}} \tag{15}$$

As previously described, it should be understood that the amplitudes (strengths) of the noise components which are entered to the first and second sound holes 41 and 51 are substantially equal to each other, and can be handled as A=A'. As a consequence, the above-explained formula (15) can be modified to become the following formula:

$$\rho(N) = \frac{|\sin\omega t - \sin(\omega t - \alpha)|_{max}}{|\sin\omega t|_{max}} \tag{16}$$

Then, the magnitude of the noise strength ratio "ρ(N)" can be expressed by the below-mentioned formula:

$$\rho(N) = \frac{|\sin\omega t - \sin(\omega t - \alpha)|_{max}}{|\sin\omega t|_{max}} = |\sin\omega t - \sin(\omega t - \alpha)|_{max} \tag{17}$$

In this case, if the above-described formula (9) is considered, then the formula (17) can be modified to become the below-mentioned formula:

$$\rho(N) = \left|\cos\left(\omega t - \frac{\alpha}{2}\right)\right|_{max} \cdot 2\sin\frac{\alpha}{2} = 2\sin\frac{\alpha}{2} \tag{18}$$

Then, if the formula (11) is considered, then the above-described formula (18) can be modified as the below-mentioned formula:

$$\rho(N) = \alpha \tag{19}$$

In this case, referring now to the above-described formula (D), a magnitude of the noise strength ratio "ρ(N)" can be expressed by the below-mentioned formula:

$$\rho(N) = \alpha < \frac{\Delta r}{R} \tag{F}$$

It should also be noted that symbol "Δr/R" implies a strength ratio of amplitude components of user voices, as indicated in the above-explained formula (A). It can be understood from the above-described formula (F) that in this voice input apparatus 1, the noise strength ratio "ρ(N)" becomes smaller than the strength ratio "Δr/R" of the user voices.

As apparent from the foregoing description, in accordance with the voice input apparatus 1 by which the strength ratio of the phase components of the user voices becomes smaller than the strength ratio of the amplitude components (refer to formula (B)), the noise strength ratio can become smaller than the user voice strength ratio (refer to formula (F)). Conversely speaking, in accordance with the voice input apparatus 1 which has been designed in such a manner that the noise strength ratio becomes smaller than the user voice strength ratio, the noise eliminating function thereof can be realized in higher precision.

Next, a description is made of a method for manufacturing the voice input apparatus 1 according to the present embodiment mode. In the present embodiment mode, the voice input apparatus 1 has been manufactured by utilizing data indicative of a corresponding relationship between such a ratio value "Δr/λ" and a noise strength ratio (strength ratio calculated based upon phase components of noise). The above-described ratio value "Δr/λ" indicates a ratio of a center-to-center distance "Δr" between the first and second sound holes 41 and 51 with respect to a wavelength "λ" of noise. It should be understood that the above-explained voice input apparatuses 2 and 3 may be similarly manufactured by performing the above-described manufacturing method.

The above-described strength ratio made based upon the phase components of the noise is expressed by the above-mentioned formula (18). As a consequence, a decibel value as to the strength ratio made based upon the phase components of the noise can be expressed by the below-mentioned formula:

$$20\log\rho(N) = 20\log\left|2\sin\frac{\alpha}{2}\right| \tag{20}$$

Figure 13:
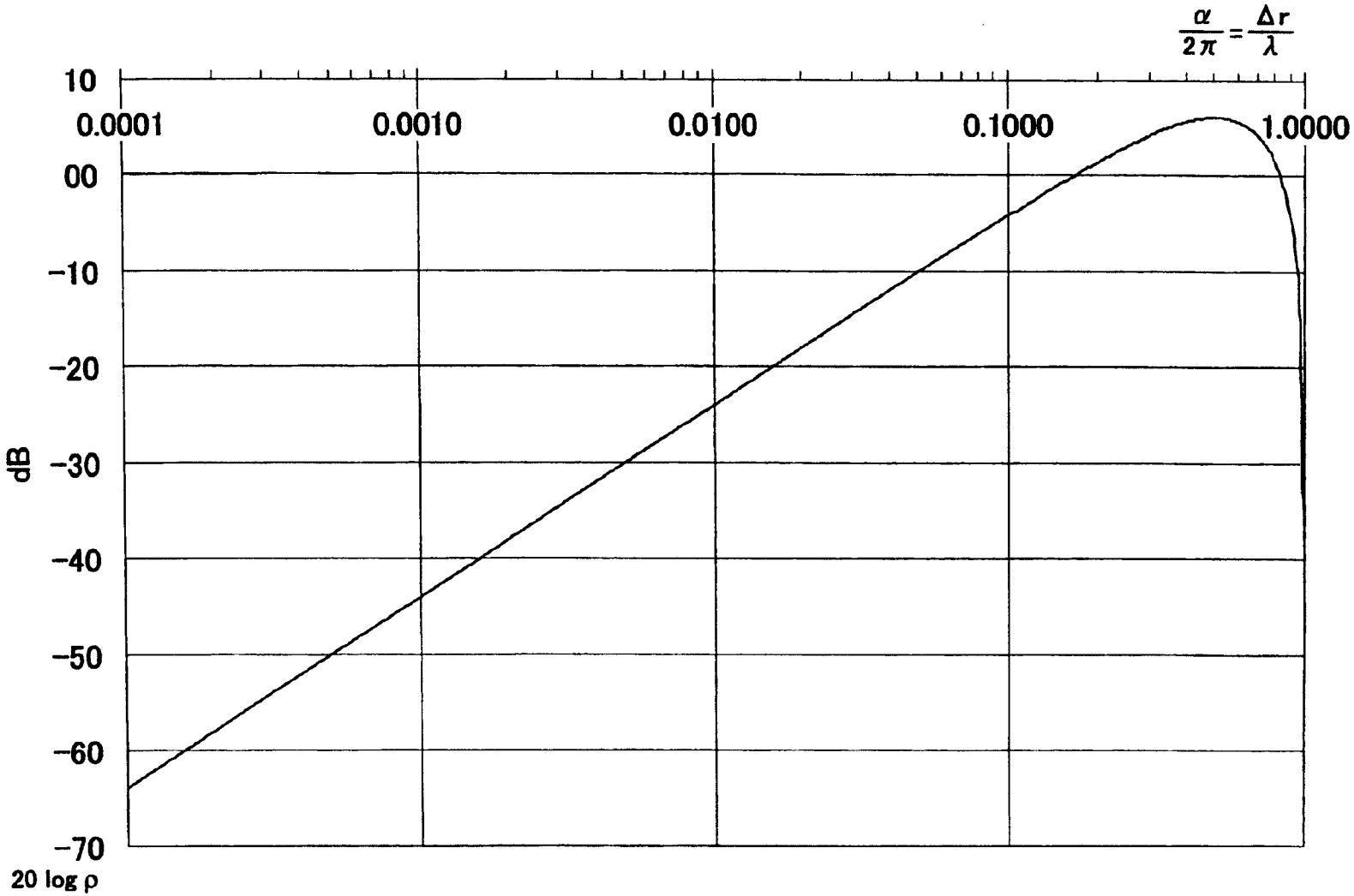
FIG. 13 is a diagram for representing one example as to data indicative of a corresponding relationship between phase differences and strength ratios.

Then, if respective values are substituted for "α" contained in the above-explained formula (20), then it is possible to clarify such a corresponding relationship between the phase difference "α" and the strength ratio made based upon the phase components of the noise. FIG. 13 represents one example of such a data which indicates a corresponding relationship between the phase difference "α" and the strength ratio when an abscissa is defined as "α/2π", and an ordinate is defined as the strength ratio (in decibel value) made based upon the phase components of the noise.

It should also be noted that as represented in the above-described formula (12), the phase difference "α" can be expressed based upon such a function of "Δr/λ" corresponding to the ratio of the distance "Δr" to the wavelength "λ", so that the abscissa of FIG. 13 can be regarded as "Δr/λ." In other words, FIG. 13 may imply such a data representative of the corresponding relationship between the strength ratio made based upon the phase components of the noise and the ratio of "Δr/λ."

Figure 14:
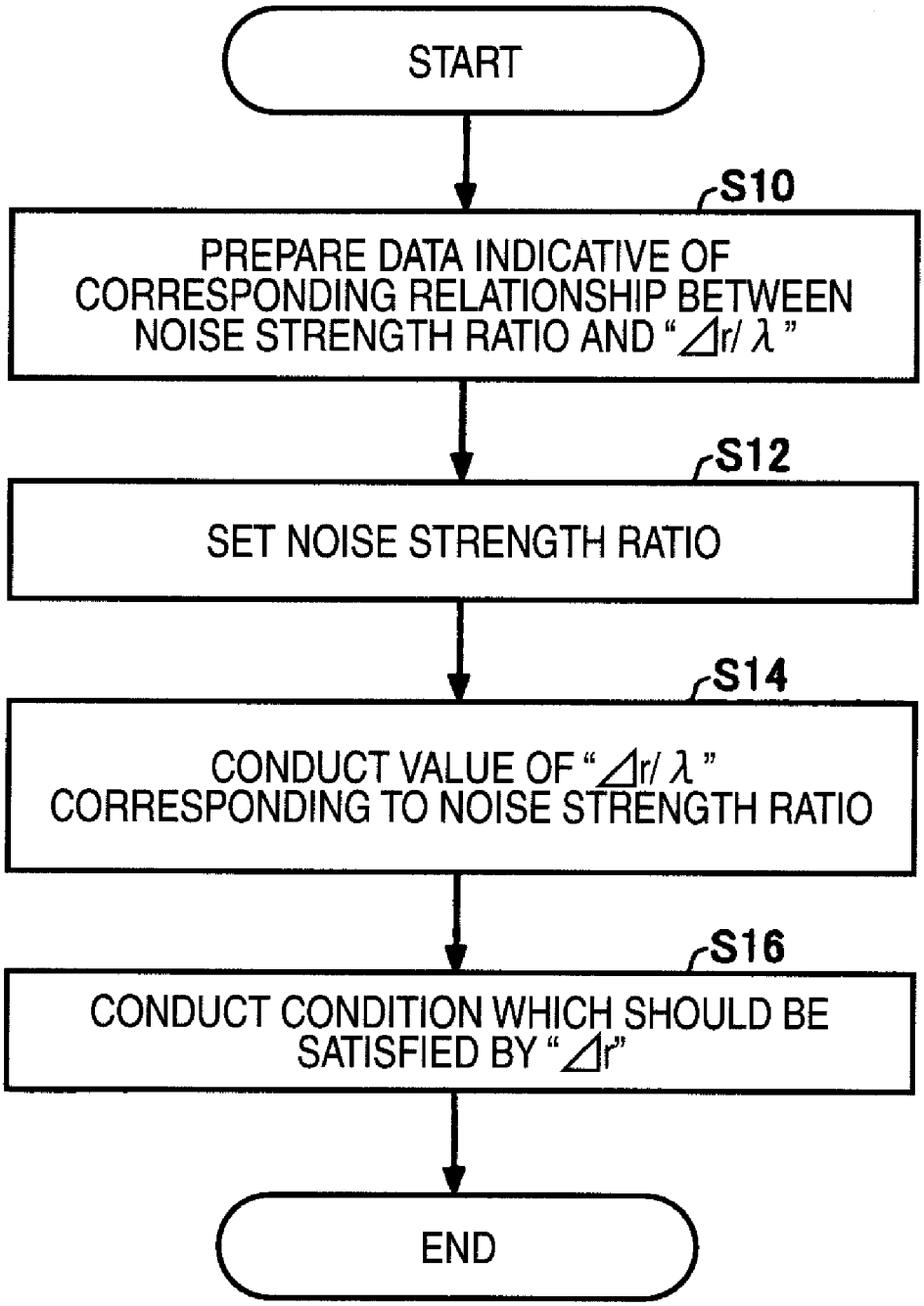
FIG. 14 is a flow chart for describing a sequential operation for manufacturing the voice input apparatus of the present embodiment mode.

In the present embodiment mode, the voice input apparatus 1 is manufactured by utilizing the above-explained data. FIG. 14 is a flow chart for describing a sequential operation for manufacturing the voice input apparatus 1 by utilizing the above-described data.

Firstly, the data (refer to FIG. 13) indicative of the corresponding relationship between the strength ratio of the noise (namely, strength ratio made based upon phase components of noise), and the ratio of "Δr/λ" is prepared (step S10).

Next, a strength ratio of noise is set (step S12), depending upon usage. It should be noted that in the present embodiment mode, it is required to set the strength ratio of the noise in such a manner that this strength of the noise is lowered. As a consequence, in this step S12, the strength ratio of the noise is set to be lower than, or equal to 0 dB.

Next, a ratio value of "Δr/λ" corresponding to the strength ratio of the noise is calculated based upon the above-explained data (step S14).

Then, a wavelength of major noise is substituted for the wavelength "λ" in order to conduct such a condition which should be satisfied by the distance "Δr" (step S16).

As a concrete example, the below-mentioned case will now be considered: That is, the voice input apparatus 1 is manufactured in such a manner that the strength ratio of the noise becomes smaller than, or equal to 0 dB under such an environmental condition that the frequency range is 3.4 KHz, namely, an upper limit for a voice frequency range of a telephone line, and a wavelength thereof is approximately 0.103 m.

Referring to FIG. 13, it can be understood that the ratio value of "Δr/λ" may be set to be smaller than, or equal to approximately 0.16 in order that the strength ratio of the noise is set to be smaller than, or equal to 0 dB. Then, the following fact can be understood: That is, the distance value "Δr" may be selected to be shorter than, or equal to approximately 8 mm. In other words, if the distance value "Δr" is set to be shorter than, or equal to, for example, approximately 8.1 mm, then such a voice input apparatus 1 having the noise eliminating function can be manufactured.

It should also be noted that normally speaking, a frequency of noise is not limited only to a single frequency. However, as to noise whose frequency is lower than the assumed frequency, since wavelengths of the noise become longer than wavelengths of sound waves having the assumed frequency, a ratio value of "Δr/λ" becomes small, so that the above-described noise is eliminated by this voice input apparatus 1. Also, as to sound waves, the higher frequencies thereof become, the faster energy thereof is attenuated. As a result, since such noise having frequencies higher than the assumed frequency is attenuated faster than the sound waves having the assumed frequency, an adverse influence given to the voice input apparatus 1 by the noise can be neglected. Under such a circumstance, the voice input apparatus 1 according to the present embodiment mode can achieve the superior noise eliminating function even under such an environmental condition that the noise having the frequencies different from the assumed frequency of the sound waves is present.

Also, as can be understood from the above-described formula (12), in the present embodiment mode, such a noise entered from a space located above a straight line was assumed, while the straight line connects the first sound hole 41 to the second sound hole 51. This noise corresponds to such a noise that a virtual interval between the first sound hole 41 and the second sound hole 51 becomes the largest interval, and corresponds to such a noise whose phase difference becomes the largest phase difference under the actual use environment. In other words, the voice input apparatus 1 has been manufactured by which such a noise whose phase difference becomes the largest phase difference can be eliminated. As a consequence, in accordance with the voice input apparatus 1 of the present embodiment mode, the noise entered from all directions to this voice input apparatus 1 can be eliminated.

Next, effects achieved by the voice input apparatus 1 will now be summarized. It should also be noted similar effects may be similarly achieved in the voice input apparatuses 2 and 3.

As previously described, in accordance with the voice input apparatus 1, the noise eliminating function can be achieved without performing a complex analysis calculating process operation. As a result, it is possible to provide such a high-quality voice input apparatus capable of deeply eliminating noise with employment of a simple structure. In particular, since the center-to-center distance "Δr" between the first sound hole 41 and the second sound hole 51 is set to be shorter than, or equal to 8.1 mm, it is possible to provide such a voice input apparatus 1 capable of realizing a higher-precision noise eliminating function with a small amount of phase distortions.

Also, since the complex analysis calculating process operation is not required, the voice input apparatus 1 can transmit voices of speakers in real time.

Next, a description is made of a delay distortion eliminating effect achieved by the voice input apparatus 1. It should also be noted that a similar delay distortion eliminating effect may be similarly achieved in the voice input apparatuses 2 and 3.

As previously described, the user voice strength ratio "ρ(S)" is expressed by the below-mentioned formula (8).

$$\rho(S) = \frac{\frac{K}{R}\left|\sin\omega t - \frac{1}{1+\Delta r/R}\sin(\omega t-\alpha)\right|_{max}}{\frac{K}{R}\left|\sin\omega t\right|_{max}} = \frac{1}{1+\Delta r/R}\left|(1+\Delta r/R)\sin\omega t - \sin(\omega t-\alpha)\right|_{max} = \frac{1}{1+\Delta r/R}\left|\sin\omega t - \sin(\omega t-\alpha) + \frac{\Delta r}{R}\sin\omega t\right|_{max} \quad (8)$$

In this formula (8), the phase component "$\rho(S)_{phase}$" of the user voice strength ratio "ρ(S)" corresponds to a term of "sin ωt−sin(ωt−α)." If the below-mentioned formulae (25) and (26) are substituted for the above-mentioned formula (8), namely $$\sin\omega t - \sin(\omega t - \alpha) = 2\sin\frac{\alpha}{2}\cdot\cos\left(\omega t - \frac{\alpha}{2}\right), \tag{9}$$

then the phase component "$\rho(S)_{phase}$" of the user voice strength ratio "ρ(S)" can be expressed by the below-mentioned formula:

$$\begin{aligned}\rho(S)_{phase} &= \left|\cos\left(\omega t - \frac{\alpha}{2}\right)\right|_{max}\cdot 2\sin\frac{\alpha}{2} \\ &= 2\sin\frac{\alpha}{2}\end{aligned} \tag{21}$$

As a consequence, a decibel value as to the above-described phase component "$\rho(S)_{phase}$" of the user voice strength ratio "ρ(S)" can be expressed by the below-mentioned formula:

$$20\log\rho(S)_{phase} = 20\log\left|2\sin\frac{\alpha}{2}\right| \tag{20}$$

Then, if the respective values are substituted for the phase difference "α" indicated in the above-explained formula (22), then it is possible to clarify such a corresponding relationship between the phase difference "α" and the strength ratio made based upon the phase components of the user voices.

Figure 15:
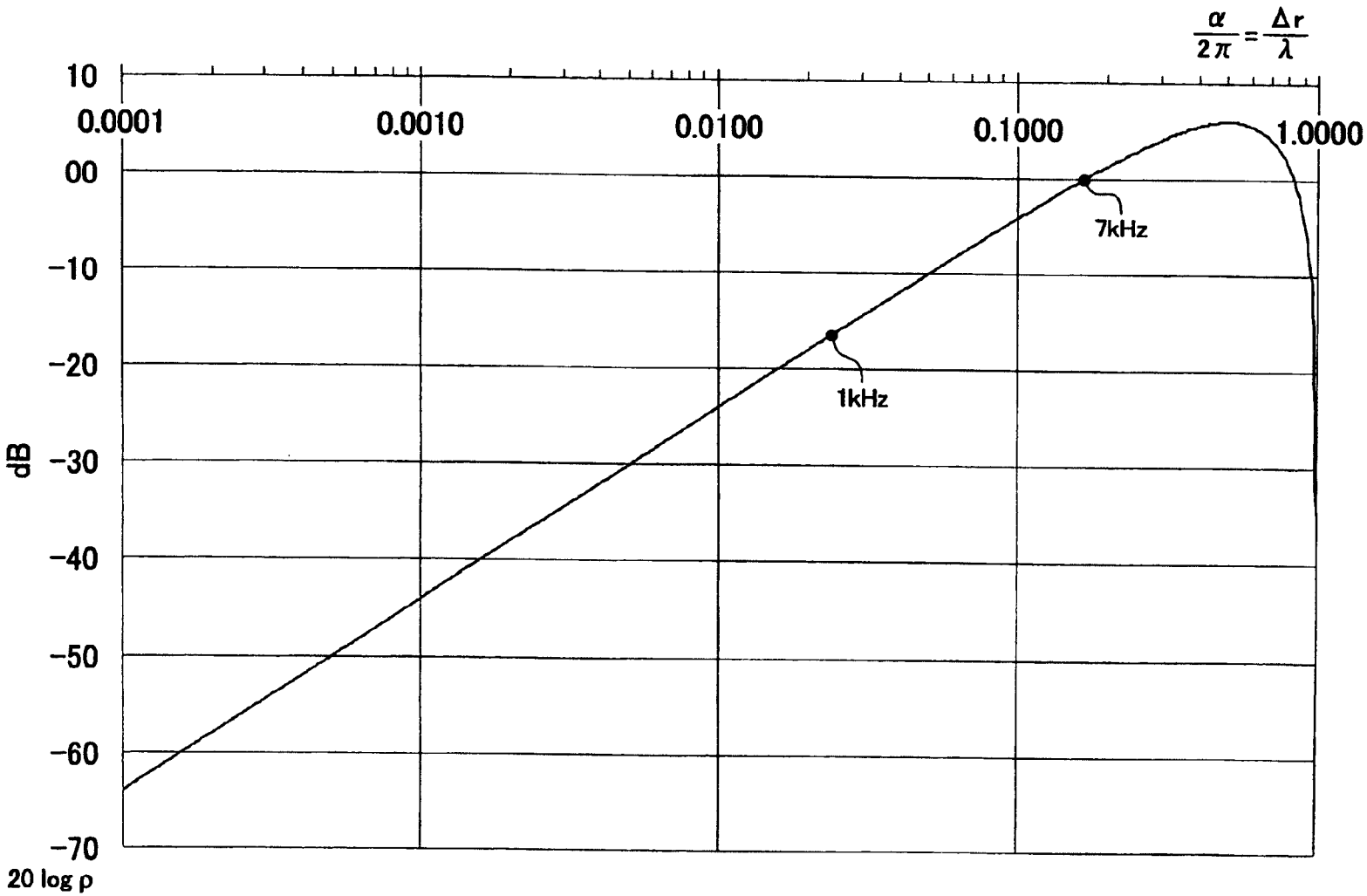
FIG. 15 is an explanatory diagram for explaining a distribution of voice strength ratios.
Figure 16:
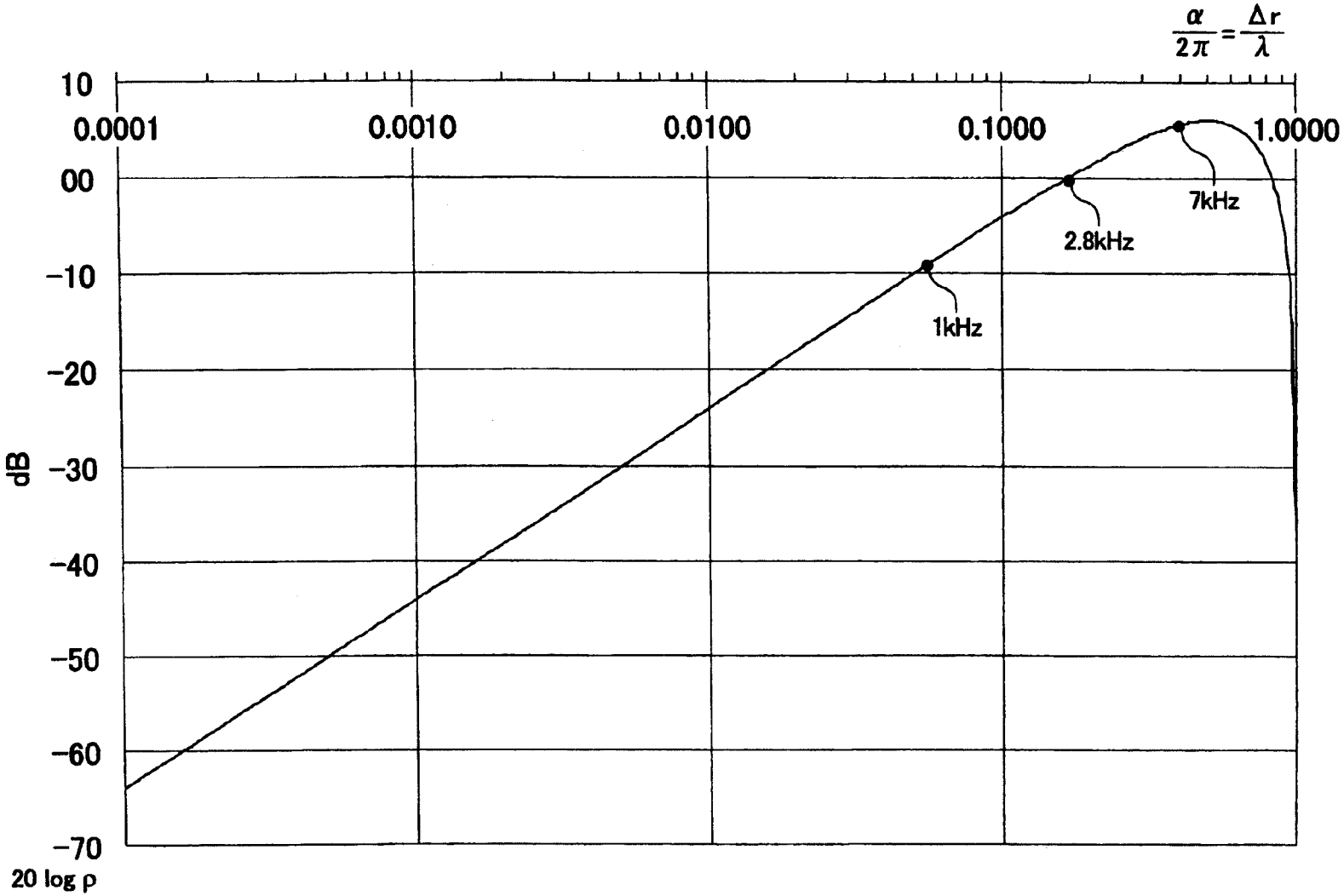
FIG. 16 is an explanatory diagram for explaining another distribution of voice strength ratios.
Figure 17:
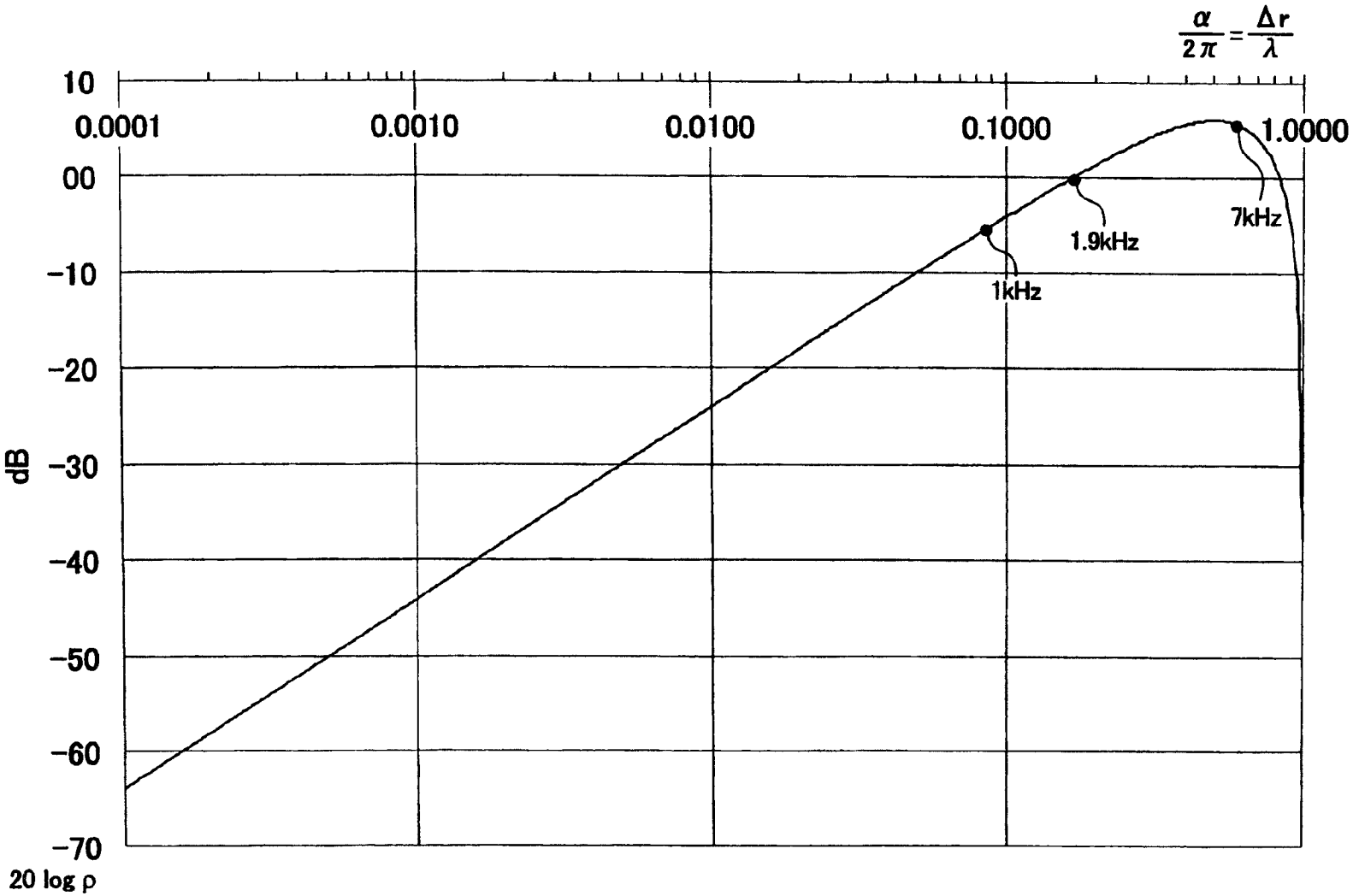
FIG. 17 is an explanatory diagram for explaining another distribution of voice strength ratios.

FIG. 15 to FIG. 17 are diagrams for explaining relationships between a microphone-to-microphone distance and the phase component "$\rho(S)_{phase}$" of the voice strength ratio "ρ(S)." In FIG. 15 to FIG. 17, an abscissa indicates the ratio "Δr/λ", whereas an ordinate indicates the phase component "$\rho(S)_{phase}$" of the user voice strength ratio "ρ(S)." The phase component "$\rho(S)_{phase}$" of the user voice strength ratio "ρ(S)" corresponds to a phase component of a sound pressure ratio between a differential microphone and a single microphone (namely, strength ratio made based upon phase components of user voices), while such a point is defined as 0 dB in which sound pressure becomes equal to differential sound pressure in the case that microphones which constitute the differential microphone is used as a single microphone.

In other words, the graphs indicated from FIG. 15 to FIG. 17 represent transitions of differential sound pressure corresponding to the ratio "Δr/λ", in which it is so conceivable that in such an area where the ordinate level is higher than, or equal to 0 dB, a delay distortion (noise) is large.

While the presently available telephone line has been designed based upon the voice frequency range of 3.4 KHz, frequencies of voices up to 7 KHz are required to be reproduced with fidelity in a speech recognition system and a voice translation system. As a consequence, consideration will now be made of an adverse influence of voice distortions caused by delays in such a case that the voice frequency range of 7 KHz is assumed.

FIG. 15 shows a distribution as to the phase component "$\rho(S)_{phase}$" of the user voice strength ratio "ρ(S)" in such a case that a sound having a frequency of 1 KHz and a sound having a frequency of 7 KHz are captured by a differential microphone under such a condition that a microphone-to-microphone distance (Δr) is 8.1 mm.

When the microphone-to-microphone distance is 8.1 mm, as indicated in FIG. 15, the phase component "$\rho(S)_{phase}$" of the user voice strength ratio "ρ(S)" is lower than, or equal to 0 dB with respect to any of the sounds having the frequencies of 1 KHz and 7 KHz.

FIG. 16 shows a distribution as to the phase component "$\rho(S)_{phase}$" of the user voice strength ratio "ρ(S)" in such a case that the sound having the frequency of 1 KHz and the sound having the frequency of 7 KHz are captured by a differential microphone under such a condition that a microphone-to-microphone distance (Δr) is 20 mm.

When the microphone-to-microphone distance becomes 20 mm, as indicated in FIG. 16, the phase component "$\rho(S)_{phase}$" of the user voice strength ratio "ρ(S)" is lower than, or equal to 0 dB with respect to the sound having the frequency of 1 KHz. However, with respect to the sound having the frequency of 7 KHz, the phase component "ρ(S) phase" of the user sound strength ratio "ρ(S)" becomes higher than, or equal to 0 dB, so that a delay distortion (noise) becomes large. It should also be noted that such a frequency that the phase component "$\rho(S)_{phase}$" of the user sound strength ratio "ρ(S)" becomes 0 dB is equal to 2.8 KHz.

FIG. 17 shows a distribution as to the phase component "$\rho(S)_{phase}$" of the user voice strength ratio "ρ(S)" in such a case that the sound having the frequency of 1 KHz and the sound having the frequency of 7 KHz are captured by a differential microphone under such a condition that a microphone-to-microphone distance (Δr) is 30 mm.

When the microphone-to-microphone distance becomes 30 mm, as indicated in FIG. 17, the phase component "$\rho(S)_{phase}$" of the user voice strength ratio "ρ(S)" is lower than, or equal to 0 dB with respect to the sound having the frequency of 1 KHz. However, with respect to the sound having the frequency of 7 KHz, the phase component "$\rho(S)_{phase}$" of the user sound strength ratio "ρ(S)" becomes higher than, or equal to 0 dB, so that a delay distortion (noise) becomes large. It should also be noted that such a frequency that the phase component "$\rho(S)_{phase}$" of the user sound strength ratio "ρ(S)" becomes 0 dB is equal to 1.9 KHz.

As a consequence, since the microphone-to-microphone distance is designed to be shorter than, or equal to 8.1 mm, it is possible to realize such a voice input apparatus having the suppression effect for the noise propagated over the long distance, which can extract the voices of the speaker with fidelity up to the frequency range of 7 KHz.

In the present embodiment mode, since the center-to-center distance between the first sound hole 41 and the second sound hole 51 is selected to be shorter than, or equal to 8.1 mm, it is possible to realize such a voice input apparatus having the suppression effect for the noise propagated over the long distance, which can extract the voices of the speaker with fidelity up to the frequency range of 7 KHz.

Also, in the voice input apparatus 1, the first sound hole 41 and the second sound hole 51 can be designed in order that the noise whose phase difference becomes the largest phase difference can be eliminated. As a result, in accordance with the above-explained voice input apparatus 1, such noise entered thereinto from the omnidirectional fields can be eliminated. In other words, in accordance with the present invention, it is possible to provide such a voice input apparatus capable of eliminating the noise entered thereinto from the omnidirectional fields.

FIG. 18A through FIG. 20B are explanatory diagrams for explaining directivity characteristics of a differential microphones with respect to sound source frequencies, microphone-to-microphone distances "Δr", and distances between the microphones and the sound sources.

Figure 18A:
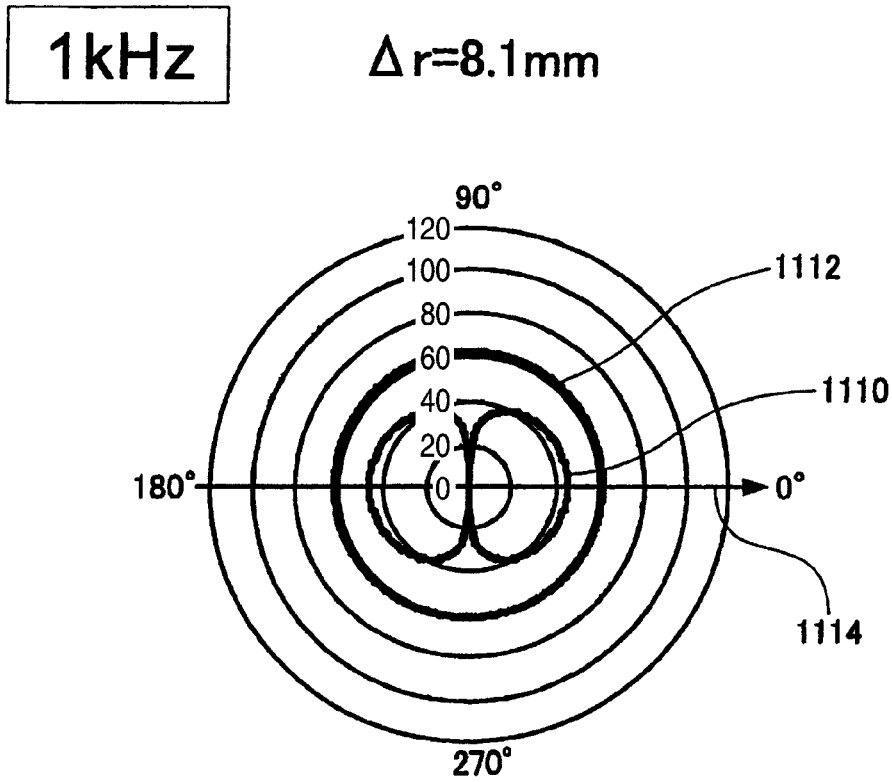
FIGS. 18A and 18B are explanatory diagrams for explaining a directivity characteristic of a differential microphone.
Figure 18B:
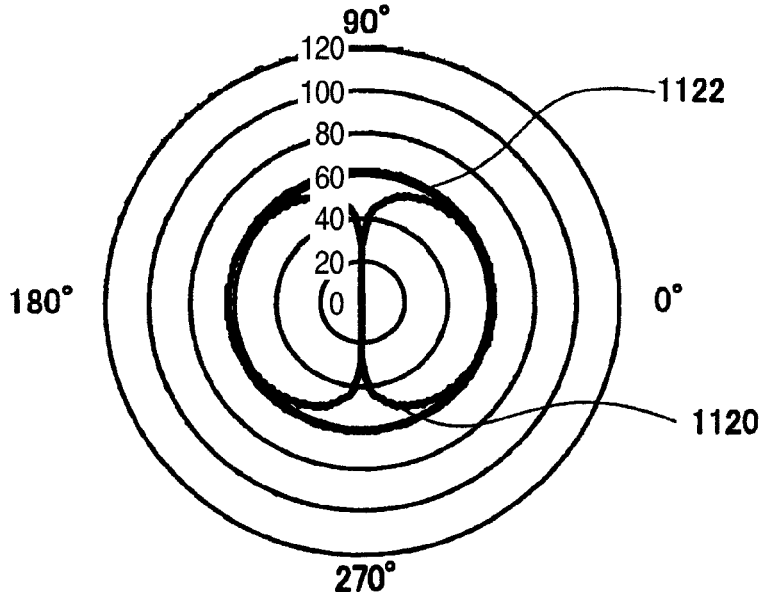

FIG. 18A and FIG. 18B are diagrams for showing characteristics as to directivity of the differential microphone in such a case that the microphone-to-microphone distance is 8.1 mm, and the distance between the microphones and the sound source is 1 m (corresponding to far-distance noise), when the frequencies of the sound source are 1 KHz and 7 KHz respectively.

Reference numeral 1110 shows a graph for representing a sensitivity (differential sound pressure) with respect to omnidirectional fields of the differential microphone, namely indicates the directivity characteristic of the differential microphone. Reference numeral 1112 indicates a graph for representing a sensitivity (sound pressure) with respect to the omnidirectional fields in such a case that the differential microphone is used as a single microphone, namely represents an equalized directivity characteristic of the single microphone.

Reference numeral 1114 shows a direction of a straight line which connects the first sound hole 41 to the second sound hole 51 in order to cause sound waves to reach both planes of such a differential microphone when this differential microphone is realized by employing a single microphone, or reference numeral 1114 denotes a direction of a straight line which connects two sets of microphones in such a case that a differential microphone is constructed by employing two sets of these microphones. The above-described straight line for connecting the first and second sound holes 41 and 51 is defined from 0 degree to 180 degrees, while both the sound hole 41 and the sound hole 51 which constitute the differential microphone have been set on this straight line. It should be understood that the direction of the above-explained straight line is assumed as 0 degree to 180 degrees, whereas a direction of such a straight line which is intersected with the above-defined direction of the straight line is assumed as 90 degrees to 270 degrees.

As represented by reference numerals 1112 and 1122, the single microphone uniformly collects sounds from the omnidirectional fields, and therefore, has no directivity characteristic. Also, as indicated by reference numerals 1110 and 1120, the differential microphone has a substantially uniform directivity characteristic over the omnidirectional fields, although the sensitivity of this differential microphone is slightly dropped along the directions of 90 degrees and 270 degrees.

As shown in FIG. 18A and FIG. 18B, in the case that the microphone-to-microphone distance is 8.1 mm, the areas indicated by the graphs 1110 and 1120 of the differential sound pressure which represent the directivity characteristics of the differential microphone have been covered within the areas indicated by the graphs 1112 and 1122 which show the equalized directivity characteristics of the single microphone respectively when the frequencies of the sound source are selected to be 1 KHz and 7 KHz. It can be understood that the differential microphone may have the superior suppression effect as to the far-distance noise (namely, noise traveled over far distance), as compared with that of the single microphone.

Figure 19A:
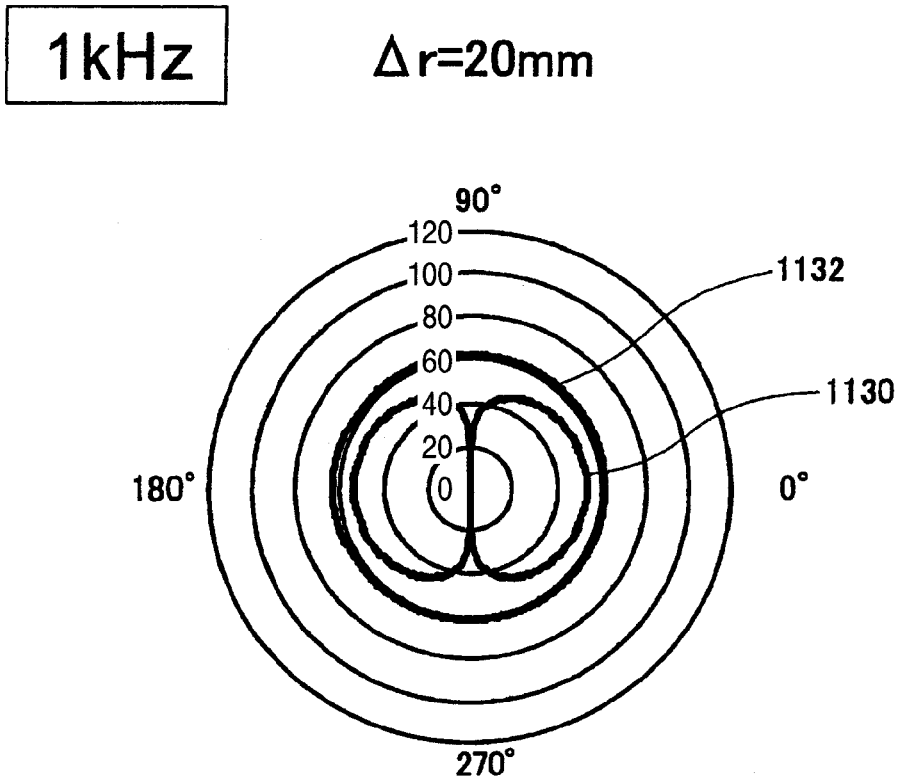
FIGS. 19A and 19B are explanatory diagrams for explaining another directivity characteristic of a differential microphone.
Figure 19B:
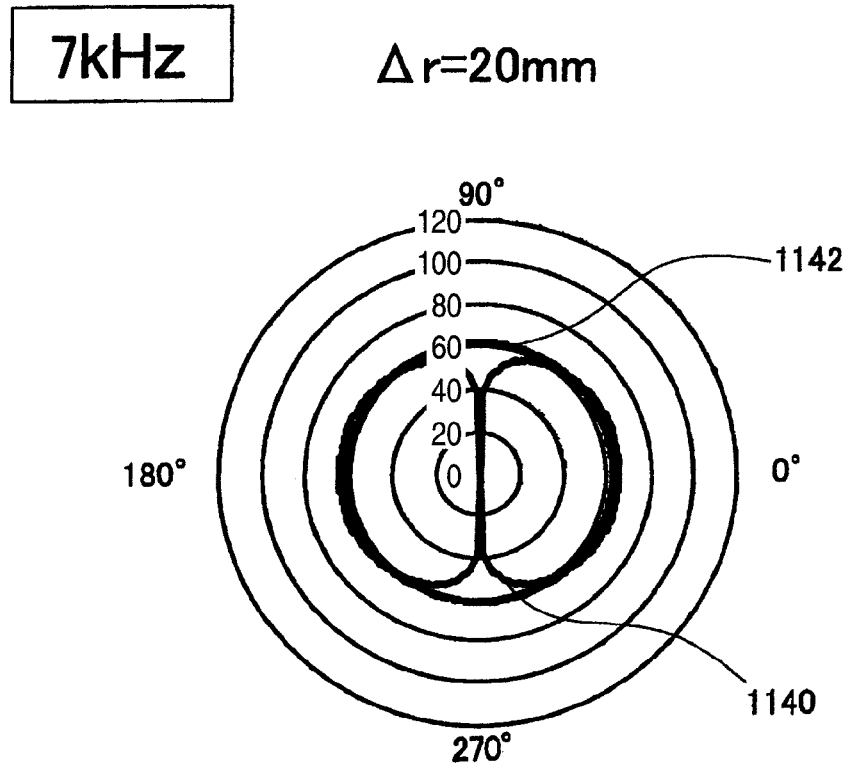

FIG. 19A and FIG. 19B are diagrams for showing characteristics as to directivity of the differential microphone in such a case that the microphone-to-microphone distance is 20 mm, and the distance between the microphones and the sound source is 1 m, when the frequencies of the sound source are 1 KHz and 7 KHz, respectively.

As shown in FIG. 19A, in such a case that the frequency of the sound source is 1 KHz, the graph 1130 indicative of the directivity characteristic of the differential microphone has been covered within the area indicated by the graph 1132 which shows the equalized directivity characteristic of the single microphone. It can be understood that the differential microphone may have the superior suppression effect as to the far-distance noise, as compared with that of the single microphone. However, as shown in FIG. 19B when the frequency of the sound source is 7 KHz, the graph 1140 indicative of the directivity characteristic of the differential microphone has not been covered in the area indicated by the graph 1142 which shows the equalized directivity characteristics of the single microphone when the frequency of the sound source is selected to by 7 KHz. It can be understood that the differential microphone may not have the superior suppression effect as to the far-distance noise, as compared with that of the single microphone.

Figure 20A:
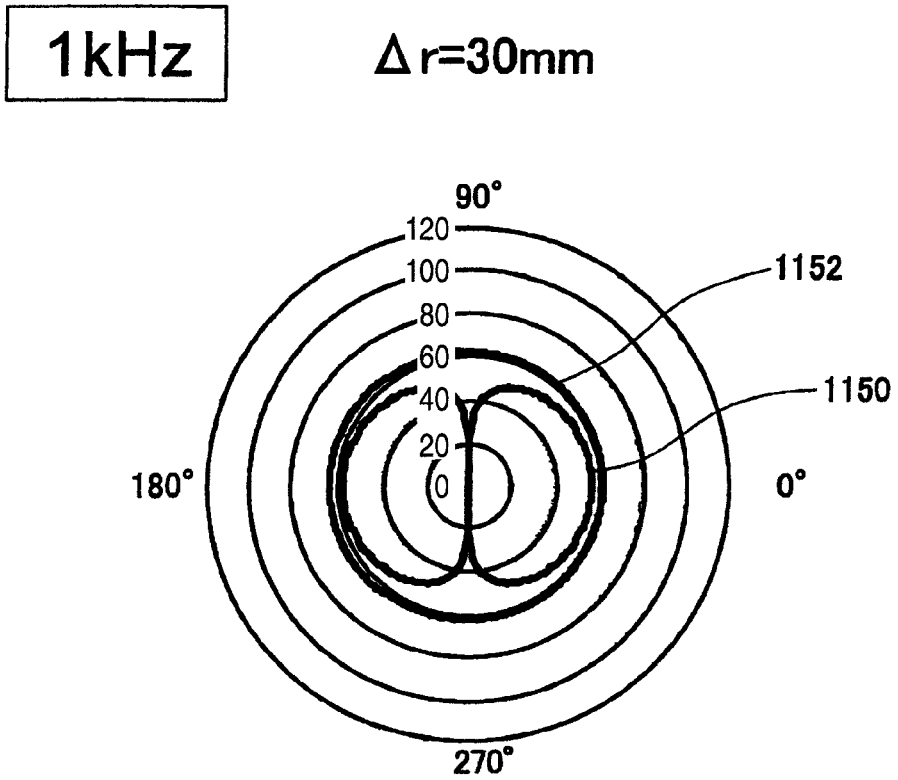
FIGS. 20A and 20B are explanatory diagrams for explaining another directivity characteristic of a differential microphone.
Figure 20B:
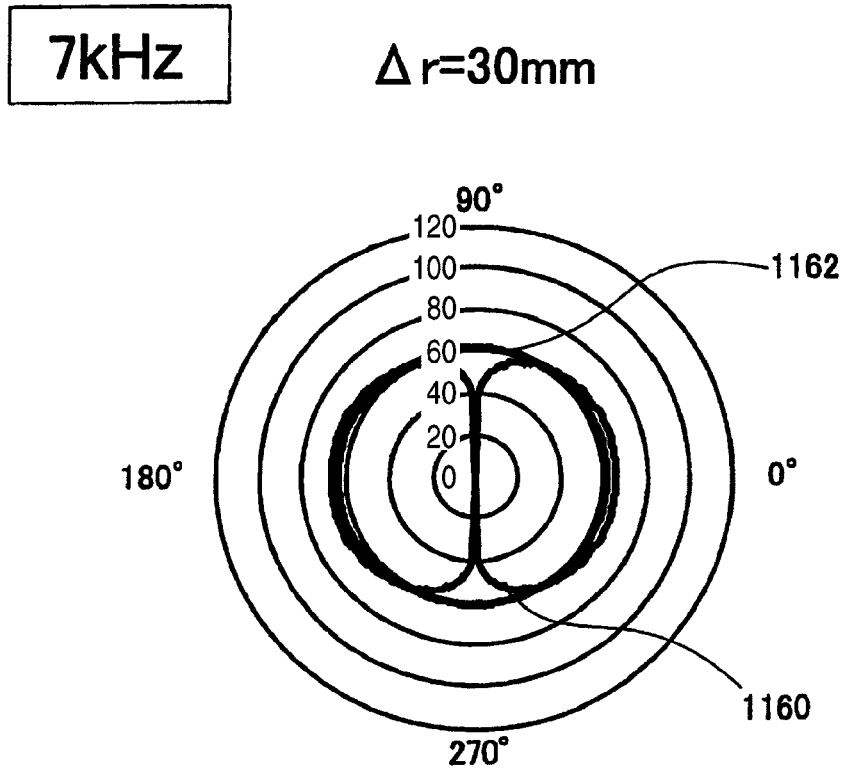

FIG. 20A and FIG. 20B are diagrams for showing characteristics as to directivity of the differential microphone in such a case that the microphone-to-microphone distance is 30 mm, and the distance between the microphones and the sound source is 1 m, when the frequencies of the sound source are 1 KHz and 7 KHz, respectively.

As shown in FIG. 20A, in such a case that the frequency of the sound source is 1 KHz, the graph 1150 indicative of the directivity characteristic of the differential microphone has been covered within the area indicated by the graph 1152 which shows the equalized directivity characteristic of the single microphone. It can be understood that the differential microphone may have the superior suppression effect as to the far-distance noise, as compared with that of the single microphone. However, as shown in FIG. 20B, when the frequency of the sound source is 7 KHz, the graph 1160 indicative of the directivity characteristic of the differential microphone has not been covered in the area indicated by the graph 1162. It can be understood that the differential microphone may not have the superior suppression effect as to the far-distance noise, as compared with that of the single microphone.

As a consequence, since the microphone-to-microphone distance of the differential microphone is selected to be shorter than, or equal to 8.1 mm, as to the sounds having the frequencies lower than, or equal to 7 KHz, the suppression effect for the far-distance noise propagated from the omnidirectional fields, which can be achieved by the differential microphone, becomes higher than that of the single microphone.

Even when a differential microphone is realized by employing a single vibration plate, a similar distance definition may be applied to a distance between the first sound hole 41 and the second sound hole 51 in order that sound waves may reach both planes of the realized differential microphone. As a consequence, in accordance with the present embodiment mode, since the center-to-center distance between the first sound hole 41 and the second sound hole 51 is designed to be shorter than, or equal to 8.1 mm, it is possible to realize such a microphone unit capable of suppressing the far-distance noise propagated from the omnidirectional fields irrespective of this directivity characteristic of the microphone unit as to the sounds having the frequencies lower than, or equal to 7 KHz.

It should also be noted that in accordance with the voice input apparatus 1, user voice components which have been reflected on a wall, and the like, and thereafter, have been entered to the first sound hole 41 and the second sound hole 51 can also be eliminated. Precisely speaking, since the user voices reflected on the wall and the like have been propagated over a long distance and thereafter are entered to the voice input apparatus 1, the entered user voices may be regarded as such voices which are generated from a sound source located far from the voice input apparatus 1, as compared with the normal user voices. Moreover, since energy of the user voices has been largely lost due to the reflections thereof, there is no possibility that sound pressure thereof is not largely attenuated between the first sound hole 41 and the second sound hole 51, which is similar to the noise components. As a consequence, in accordance with the voice input apparatus 1, similar to the noise, the user voice components (namely, as one sort of noise), which have been reflected on the wall and the like and thereafter are entered to this voice input apparatus 1 may also be eliminated.

Similarly, the voice input apparatus 1 can suppress howling sounds, and also, large non-usual noise generated from construction sites and the like over the omnidirectional fields.

Then, if the voice input apparatus 1 is utilized, then the voice input apparatus 1 can acquire the signals indicative of the user voices, which do not contain the noise. As a consequence, since the voice input apparatus 1 is utilized, it is possible to realize speech recognitions in higher precision, speech authentication in higher precision, command producing process operations in higher precision, and a higher-precision voice conference system.

As previously described, in the voice input apparatus 1 according to the present embodiment mode, the sound pressure entered to the first sound hole 41 and the sound pressure entered to the second sound hole 51 can be expressed by the above-explained formulae (2) and (3), respectively. As a consequence, sound pressure "ΔP" (5) detected as the differential microphone can be expressed by the below-mentioned formula:

$$\Delta P = K\left(\frac{1}{R} - \frac{1}{R+\Delta r}\right) \tag{21}$$

In the above-described formula (21), when a sound hole-to-sound hole distance is assumed as Δr=5 mm, and a distance "R" between the sound holes and the sound source is assumed as 50 mm, the sound pressure "ΔP" (5) detected as the differential microphone can be expressed by the below-mentioned formula:

$$\begin{aligned}\Delta P(5) &= K\left(\frac{1}{50} - \frac{1}{50+5}\right) \\ &= \frac{K}{550}\end{aligned} \tag{22}$$

The reason why the sound hole-to-sound hole distance is assumed as Δr=5 mm is given based upon such a fact: That is, a sound hole-to-sound hole distance is nearly equal to 5.2 mm in such a case that the sound hole-to-sound hole distance is designed based upon the above-described method for manufacturing the voice input apparatus in such a manner that a noise strength of the frequency 1 KHz becomes smaller than, or equal to 20 dB, which corresponds to the major frequency of the surrounding noise. Also, the reason why the distance "R" between the sound holes and the sound source is assumed as 50 mm is given as follows: That is, in such a case that the voice input apparatus is employed as a close-talking type voice input apparatus, a distance between sound holes and a sound source is designed to be shorter than, or equal to 50 mm under normal condition.

In the voice input apparatus 1 according to the present embodiment mode, while this sound pressure "ΔP" (5) is employed as the reference, attenuations of 6 dB (namely, ½) can be set as an allowable range of the sensitivities. Assuming now that the sound hole-to-sound hole distance is defined as Δr=8.1 mm, such a distance "R" between the sound holes and the sound source which can satisfy the above-described allowable range can be calculated based upon the below-mentioned formula:

$$\Delta P(8.1) = K\left(\frac{1}{R} - \frac{1}{R+8.1}\right) = \frac{K}{1100} \tag{23}$$

$$\rightarrow R \approx 90 \text{ [mm]} \tag{24}$$

As a consequence, a voice sound input apparatus is mounted and utilized in such a manner that the distance "R" between the sound sources and the sound source becomes shorter than, or equal to 90 mm, so that such a voice input apparatus whose sensitivity is kept higher than, or equal to a predetermined sensitivity value can be realized.

The present invention contains structures which are essentially identical to the structures described in the embodiment modes, while the first-mentioned structures are given as, for example, such structures whose functions, methods, and results are identical to those of the structures explained in the embodiment modes, otherwise, such structures having objects and effects, which are identical to those of the embodiment structures. Also, the present invention contains such an arrangement that a non-essential portion of the structures explained in the embodiment mode has been replaced. Also, the present invention contains such a structure capable of achieving the same operation effect as that of the structure described in the embodiment mode, or another structure capable of achieving the same object as that of the structure explained in the embodiment mode. Further, the present invention may cover such an arrangement constructed by adding the known technique to the structures explained in the embodiment modes.

What is claimed is:

1. A voice sound input apparatus, adapted to be inputted a sound and configured to output sound data, comprising: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole, and adapted to extend toward a sound source predicted position located at a vertical direction of a display screen of the display unit, wherein a distance between the first sound hole and the second sound hole is set so that a strength ratio between a strength of differential sound pressure of sounds entered to the first sound hole and the second sound hole and a strength of sound pressure of the sound entered to the first sound hole with respect to phase components becomes smaller than the strength ratio with respect to amplitude components in a case that the sounds have a predetermined frequency range.

2. The voice input apparatus as claimed in claim 1 wherein the predetermined frequency range is a frequency range lower than or equal to 7 KHz.

3. A voice sound input apparatus, adapted to be inputted a sound and configured to output sound data, comprising: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole, and adapted to extend toward a sound source predicted position located at a vertical direction of a display screen of the display unit; wherein the first microphone and the second microphone is located at a position where a distance between the first sound hole and the second sound hole is shorter than or equal to 8.1 mm.

4. The voice input apparatus according to claim 1, wherein the microphone holding unit is detachably attached to a main body.

5. The voice input apparatus according to claim 4, wherein: the signal processing unit includes a detecting unit configured to detect whether or not the microphone holding unit is attached to the main body; the signal processing unit is configured to perform the signal processing based on the output from the first microphone in a case that the detecting unit detects that the microphone holding unit is not attached to the main body; and the signal processing unit is configured to perform the signal processing based on the output from the first microphone and the output from the second microphone in a case that the detecting unit detects that the microphone holding unit is attached to the main body.

6. The voice input apparatus according to claim 1, wherein: said microphone holding unit is formed with the second sound hole.

7. A voice sound input apparatus, adapted to be inputted a sound and configured to output sound data, comprising: a display unit; a first microphone, related to a first sound hole; a second microphone, related to a second sound hole; a signal processing unit, configured to perform a signal processing based on at least one of outputs from the first microphone and the second microphone; and a microphone holding unit, formed in a rod shape, formed with the first sound hole and the second sound hole, and adapted to extend toward a sound source predicted position located at a vertical direction of a display screen of the display unit; wherein: the signal processing unit includes a detecting unit configured to detect whether or not the microphone holding unit is attached to a main body; the signal processing unit is configured to perform the signal processing based on the output from the second microphone in a case that the detecting unit detects that the microphone holding unit is not attached to the main body; and the signal processing unit is configured to perform the signal processing based on the output from the first microphone and the output from the second microphone in a case that the detecting unit detects that the microphone holding unit is attached to the main body.

8. The voice input apparatus according to claim 1, wherein a sectional area of the first sound hole is equal to a sectional area of the second sound hole.

9. The voice input apparatus according to claim 1, wherein a volume of an internal space of the first sound hole is equal to a volume of an internal space of the second sound hole.

10. The voice input apparatus according to claim 1, further comprising: a first vibration plate corresponding to the first microphone; and a second vibration plate corresponding to the second microphone, wherein a path length from an opening plane of the first sound hole to the first vibration plate is equal to a path length from an opening plane of the second sound hole to the second vibration plate.

11. The voice input apparatus according to claim 1, wherein the signal processing unit is configured to generate a differential signal between an output signal of the first microphone and an output signal of the second microphone.

12. The voice sound input apparatus according to claim 1, further comprising a vibration plate corresponding to both the first microphone and the second microphone, wherein a path length from an opening plane of the first sound hole to the vibration plate is equal to a path length from an opening plane of the second sound hole to the vibration plate.

13. The voice sound input apparatus according to claim 1, wherein a sectional area of the first sound hole is larger than a sectional area of the second sound hole.

14. The voice sound input apparatus according to claim 1, further comprising a mounting unit, configured to place the first sound hole at a position where a distance between the first sound hole and a sound source predicted position is shorter than or equal to 90 mm.

15. The voice sound input apparatus according to claim 1, wherein the microphone holding unit is configured to adjust a distance between the first sound hole and a sound source predicted position due to at least one of pivotal movement, telescopic movement and deforming movement.

16. The voice sound input apparatus according to claim 1, wherein the microphone holding unit is configured to adjust the distance between the first sound hole and the second sound hole.

17. The voice sound input apparatus according to claim 1, wherein the microphone holding unit is configured to maintain the distance between the first sound hole and the second sound hole.

18. The voice sound input apparatus according to claim 1, wherein the signal processing unit is configured to perform a beam forming processing in a predetermined angle range with reference to a predetermined direction.

19. The voice sound input apparatus according to claim 18, wherein the signal processing unit includes a switching process unit configured to switch whether or not the beam forming processing is performed.

20. The voice sound input apparatus as claimed in claim 19 wherein: the signal processing unit includes a microphone sensitivity detecting unit configured to detect a sensitivity of at least one of the first microphone and the second microphone; and the signal processing unit is configured to switch whether or not the beam forming processing is performed based on a detection result of the microphone sensitivity detecting unit.

21. The voice sound input apparatus according to claim 18, wherein the predetermined direction is a direction directed from the second sound hole to the first sound hole.

* * * * *